US009132977B2

(12) United States Patent
Ueda et al.

(10) Patent No.: US 9,132,977 B2
(45) Date of Patent: Sep. 15, 2015

(54) SHEET CONVEYING APPARATUS AND IMAGE FORMING APPARATUS

(71) Applicants: Naoto Ueda, Ibaraki (JP); Makoto Nakura, Ibaraki (JP); Shingo Takai, Ibaraki (JP); Koichi Kudo, Kanagawa (JP); Satoshi Ueda, Ibaraki (JP); Akira Kobashi, Ibaraki (JP)

(72) Inventors: Naoto Ueda, Ibaraki (JP); Makoto Nakura, Ibaraki (JP); Shingo Takai, Ibaraki (JP); Koichi Kudo, Kanagawa (JP); Satoshi Ueda, Ibaraki (JP); Akira Kobashi, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/496,188

(22) Filed: Sep. 25, 2014

(65) Prior Publication Data

US 2015/0008639 A1 Jan. 8, 2015

Related U.S. Application Data

(62) Division of application No. 13/572,832, filed on Aug. 13, 2012, now abandoned.

(30) Foreign Application Priority Data

Aug. 25, 2011 (JP) ..... 2011-183771
May 30, 2012 (JP) ..... 2012-123112

(51) Int. Cl.
*B65H 7/02* (2006.01)
*B65H 7/06* (2006.01)
(Continued)

(52) U.S. Cl.
CPC ..... *B65H 7/06* (2013.01); *B65H 5/062* (2013.01); *B65H 5/068* (2013.01); *B65H 7/14* (2013.01); *B65H 9/002* (2013.01); *B65H 9/20* (2013.01); *B65H 85/00* (2013.01); *G03G 15/231* (2013.01); *G03G 15/5029* (2013.01); *G03G 15/6561* (2013.01); *B65H 2511/11* (2013.01);
(Continued)

(58) Field of Classification Search
CPC ..... B65H 5/062; B65H 7/02; B65H 7/14; B65H 7/06; B65H 85/00; B65H 2511/11; B65H 2511/17; B65H 2511/172; B65H 2601/125; G03G 15/5029; G03G 15/5095; G03G 15/6561; G03G 15/6567; G03G 15/231; G03G 2215/0059; G03G 2215/00561; G03G 2215/00586; G03G 2215/00734
See application file for complete search history.

(56) References Cited

U.S. PATENT DOCUMENTS 5,983,066 A 11/1999 Abe et al.
6,356,735 B1 3/2002 Hozumi
(Continued)

FOREIGN PATENT DOCUMENTS

JP 2010-241600 10/2010
JP 2010-271407 12/2010
(Continued)

*Primary Examiner* — Ernesto Suarez
(74) *Attorney, Agent, or Firm* — IPUSA, PLLC

(57) ABSTRACT

A sheet conveying apparatus includes a sheet conveying unit including a drive roller and a driven roller; a downstream detection unit and an upstream detection unit; a conveying amount measuring unit that measures a conveying amount of the sheet; and a conveying distance calculation unit that calculates a conveying distance of the sheet, wherein a distance between the downstream detection unit and the upstream detection unit or a perimeter of one of the drive roller and the driven roller is set such that an expected conveying distance calculated based on a set sheet length of an expected value of the sheet becomes a substantially integer multiple of a perimeter of the one of the drive roller and the driven roller.

8 Claims, 17 Drawing Sheets

(51) Int. Cl.

| | |
|---|---|
| ***B65H 7/14*** | (2006.01) |
| ***G03G 15/00*** | (2006.01) |
| ***B65H 85/00*** | (2006.01) |
| ***B65H 5/06*** | (2006.01) |
| ***G03G 15/23*** | (2006.01) |
| ***B65H 9/00*** | (2006.01) |
| ***B65H 9/20*** | (2006.01) |

(52) U.S. Cl.

CPC ..... *B65H2511/172* (2013.01); *B65H 2511/414* (2013.01); *B65H 2553/51* (2013.01); *B65H 2553/81* (2013.01); *B65H 2553/82* (2013.01); *B65H 2701/1311* (2013.01); *B65H 2701/1313* (2013.01); *G03G 15/6567* (2013.01); *G03G 2215/0059* (2013.01); *G03G 2215/00586* (2013.01); *G03G 2215/00734* (2013.01)

(56) References Cited

U.S. PATENT DOCUMENTS

| | | | | |
|---|---|---|---|---|
| 7,561,843 | B2 | 7/2009 | deJong et al. | |
| 7,775,519 | B2 | 8/2010 | Takahashi et al. | |
| 7,792,479 | B2 | 9/2010 | Yasumoto | |
| 7,978,994 | B2 | 7/2011 | Ogihara et al. | |
| 8,131,171 | B2 | 3/2012 | Ohshima et al. | |
| 8,320,814 | B2 | 11/2012 | Tsukamoto et al. | |
| 8,608,164 | B2 | 12/2013 | Takai et al. | |
| 8,910,939 | B2 * | 12/2014 | Nakura et al. | 271/272 |
| 9,004,487 | B2 * | 4/2015 | Takayasu | 271/272 |
| 2005/0174377 | A1 | 8/2005 | Fujikura | |
| 2010/0239282 | A1 | 9/2010 | Ashikawa et al. | |
| 2010/0247115 | A1 * | 9/2010 | Ohshima et al. | 399/16 |
| 2010/0329759 | A1 | 12/2010 | Furuya et al. | |
| 2011/0058828 | A1 | 3/2011 | Tsukamoto et al. | |
| 2011/0064425 | A1 | 3/2011 | Kazama et al. | |
| 2011/0076077 | A1 | 3/2011 | Morofuji et al. | |
| 2013/0195482 | A1 | 8/2013 | Nakura et al. | |

FOREIGN PATENT DOCUMENTS

| | | |
|---|---|---|
| JP | 2011-006202 | 1/2011 |
| JP | 2011-020842 | 2/2011 |
| JP | 2011-063332 | 3/2011 |
| JP | 2011-068460 | 4/2011 |
| JP | 2011-079662 | 4/2011 |

* cited by examiner a = 70 mm

| Ls (mm) | Pe = Ls − a (mm) | 2πr (mm) |
|---|---|---|
| 210 | 140 | 2 4 5 7 10 14 20 28 35 70 |
| 420 | 350 | |

FIG.7

SHEET CONVEYING APPARATUS AND IMAGE FORMING APPARATUS

CROSS-REFERENCE TO RELATED APPLICATION

This application is a divisional application of U.S. patent application Ser. No. 13/572,832 filed on Aug. 13, 2012, which is based on Japanese Priority Application No. 2011-183771 filed on Aug. 25, 2011, and Japanese Priority Application No. 2012-123112 filed on May 30, 2012, the entire contents of which are hereby incorporated by reference.

BACKGROUND OF THE INVENTION

1. Field of the Invention

The present invention relates to a sheet conveying apparatus and an image forming apparatus.

2. Description of the Related Art

In a commercial printing business, Print on Demand (POD) by an image forming apparatus using electrophotography instead of using an offset printing machine has been provided for printing small lots of data, various types of data or variable data has been increasing. In order to meet this kind of need, registration on both surfaces is required for the image forming apparatus using electrophotography comparable to that of the offset printing machine.

There are two main reasons for causing a registration error occurring in both-sides printing, including registration error in the lateral and the vertical directions, and a skew error between a sheet and an image. Further, for an image forming apparatus including a heat fixing device, an image size error caused by expansion and contraction of the sheet is also a reason for registration error occurring in both-sides printing.

In order to automatically correct the registration error in both-sides printing caused by the image size error, it is required to use a technique to automatically and accurately measure the size of a sheet, the conveying distance of the sheet or the like. Thus, a technique to measure the length of the sheet by detecting passing of a front end and a rear end of the sheet and calculating the length of the sheet based on the period between the passing of the front end and the rear end of the sheet, or the like is known.

For example, according to Patent Documents 1 to 3, a sheet length measurement means is disclosed. The sheet length measurement means includes a rotation amount measurement means that measures a rotation amount of a length measuring roller which is rotated in accordance with a movement of a sheet or the like, and edge sensors provided before and after the length measuring roller to detect passing of the sheet. The sheet length measurement means measures the length of the sheet or the like in the conveying direction of the sheet based on the rotation amount of the length measuring roller and detections by the edge sensors.

However, when there is an eccentric amount of the length measuring roller, if the phases of the length measuring roller at a start timing and an end timing are different, an error may be caused in the measured sheet length.

Thus, according to Patent Document 4, a length measuring apparatus including a length measuring roller, a first upstream edge sensor, a second upstream edge sensor and a downstream edge sensor is disclosed. In the length measuring apparatus, a length of the sheet in the conveying direction is calculated by selecting a length among a first length of a sheet measured within a first detection period by the first upstream edge sensor and the downstream edge sensor, and a second length of a sheet measured within a second detection period by the second upstream edge sensor and the downstream edge sensor, which becomes closer to an integer multiple of the perimeter of the length measuring roller.

According to Patent Document 4, it is described that a measurement error in the measured sheet length obtained by using the length measuring roller caused by the eccentric amount of the length measuring roller can be reduced.

However, according to the length measuring apparatus disclosed in Patent Document 4, there may be a case when both the first length of the sheet measured within the first detection period by the first upstream edge sensor and the downstream edge sensor, and the second length of the sheet measured within the second detection period by the second upstream edge sensor and the downstream edge sensor do not become an integer multiple of the perimeter of the length measuring roller. In such a case, the measurement error in the measured sheet length obtained by using the length measuring roller caused by the eccentric amount of the length measuring roller cannot be reduced.

PATENT DOCUMENT

[Patent Document 1] Japanese Laid-open Patent Publication No. 2010-241600

[Patent Document 2] Japanese Laid-open Patent Publication No. 2011-006202

[Patent Document 3] Japanese Laid-open Patent Publication No. 2011-020842

[Patent Document 4] Japanese Laid-open Patent Publication No. 2011-079662

SUMMARY OF THE INVENTION

The present invention is made in light of the above problems, and provides a sheet conveying apparatus capable of reducing a measurement error in a sheet conveying distance caused by an eccentric amount of a roller whose rotation amount is counted to obtain the sheet conveying distance.

According to an embodiment, there is provided a sheet conveying apparatus including a sheet conveying unit that conveys a sheet including a drive roller which is driven to be rotated by a driving unit, and a driven roller which is rotated in accordance with the drive roller while the sheet is interposed between the drive roller and the driven roller; a downstream detection unit that detects the sheet downstream of the sheet conveying unit in a conveying direction of the sheet; an upstream detection unit that detects the sheet upstream of the sheet conveying unit in the conveying direction of the sheet; a conveying amount measuring unit that measures a conveying amount of the sheet conveyed by the sheet conveying unit based on a rotation amount of one of the drive roller and the driven roller; and a conveying distance calculation unit that calculates a conveying distance of the sheet conveyed by the sheet conveying unit based on the conveying amount measured by the conveying amount measuring unit within a period determined by detections made by the first detection unit and the second detection unit, wherein a distance between the downstream detection unit and the upstream detection unit or a perimeter of the one of the drive roller and the driven roller is set such that an expected value of the conveying distance calculated based on a set sheet length of an expected sheet for which the conveying distance is to be calculated becomes a substantially integer multiple of a perimeter of one of the drive roller and the driven roller.

According to another embodiment, there is provided an image forming apparatus including a transfer unit that transfers a toner image onto a sheet; and the sheet conveying apparatus.

Note that also arbitrary combinations of the above-described constituents, and any exchanges of expressions in the present invention, made among method, device, system, recording medium, computer program and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

FIG. 7 is a view showing an example of a relationship between a set length "Ls" of an expected sheet, an expected conveying distance "Pe", and the perimeter of a driven roller of an embodiment;

DETAILED DESCRIPTION OF THE PREFERRED EMBODIMENTS

Figure 1:
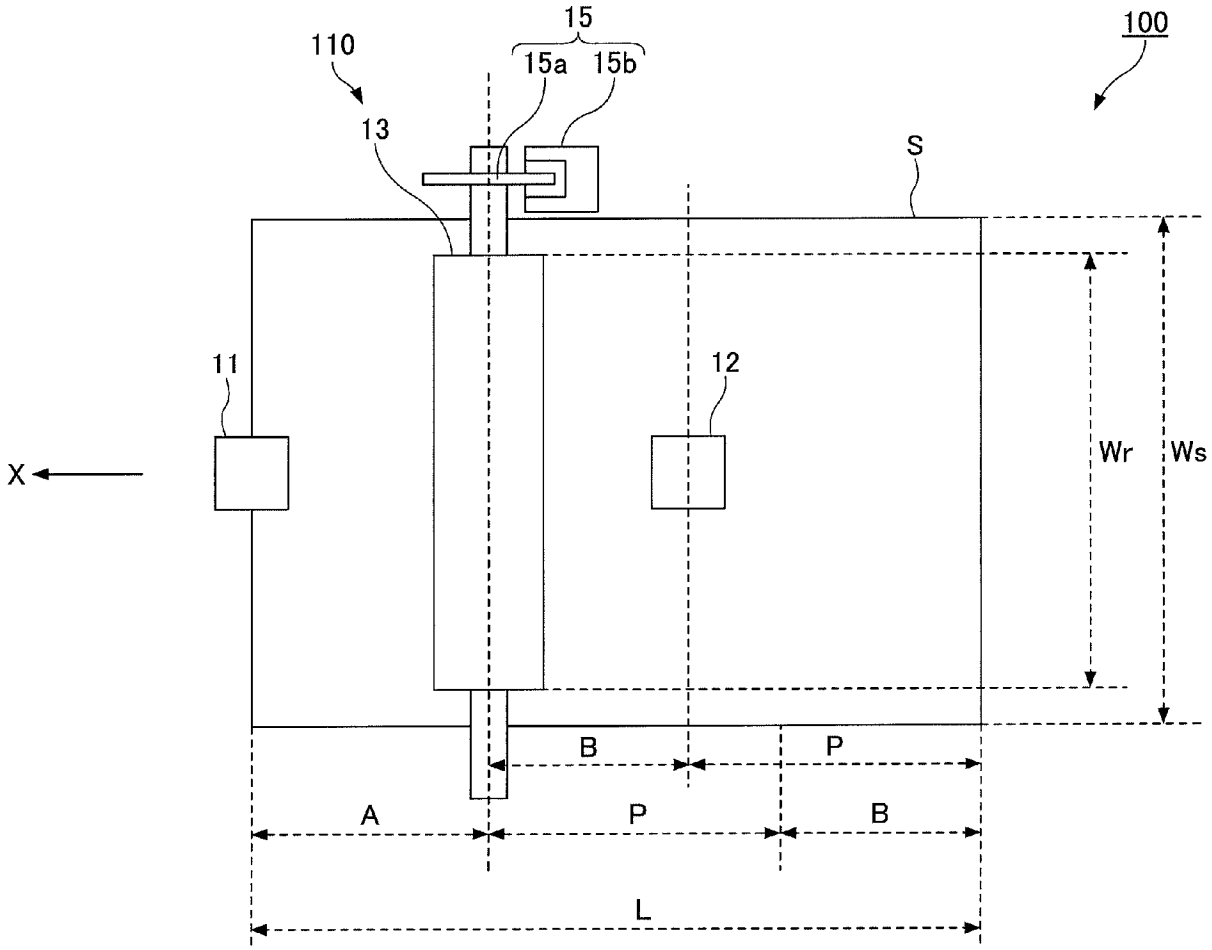
FIG. 1 a plan view schematically showing an example of a structure of a sheet conveying apparatus of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment

Structure of Sheet Conveying Apparatus

Figure 2:
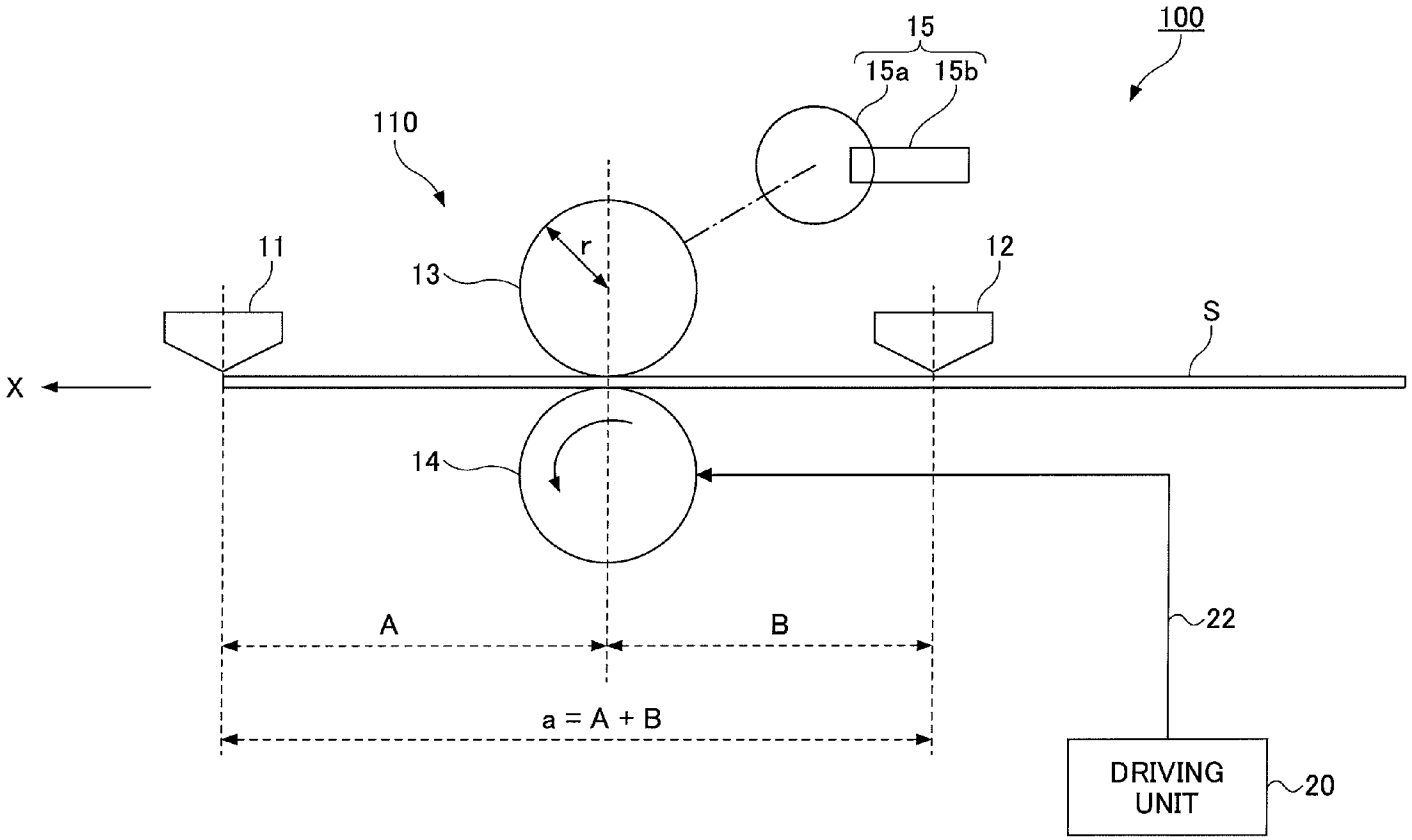
FIG. 2 is a cross-sectional view schematically showing an example of a structure of a sheet conveying apparatus of an embodiment.

FIG. 1 and FIG. 2 are views showing an outline constitution of a sheet conveying apparatus 100 of the embodiment. FIG. 1 is a plan view schematically showing an example of a structure of the sheet conveying apparatus 100 and FIG. 2 is a cross-sectional view schematically showing an example of a structure of the sheet conveying apparatus 100.

The sheet conveying apparatus 100 includes a sheet conveying unit 110 provided on a conveying path of a sheet S, a start trigger sensor 11, a stop trigger sensor 12, and a rotary encoder 15. The sheet S may be a paper, an OHP or the like. The sheet conveying unit 110 includes a drive roller 14 and a driven roller 13. The drive roller 14 is driven to be rotated by a driving unit 20 (see FIG. 2) such as a motor or the like and a driving force transmitting unit 22 (see FIG. 2) such as a gear, a belt or the like. The driven roller 13 is rotated in accordance with the rotation of the drive roller 14 while a sheet S is interposed between the drive roller 14 and the driven roller 13.

Figure 3:
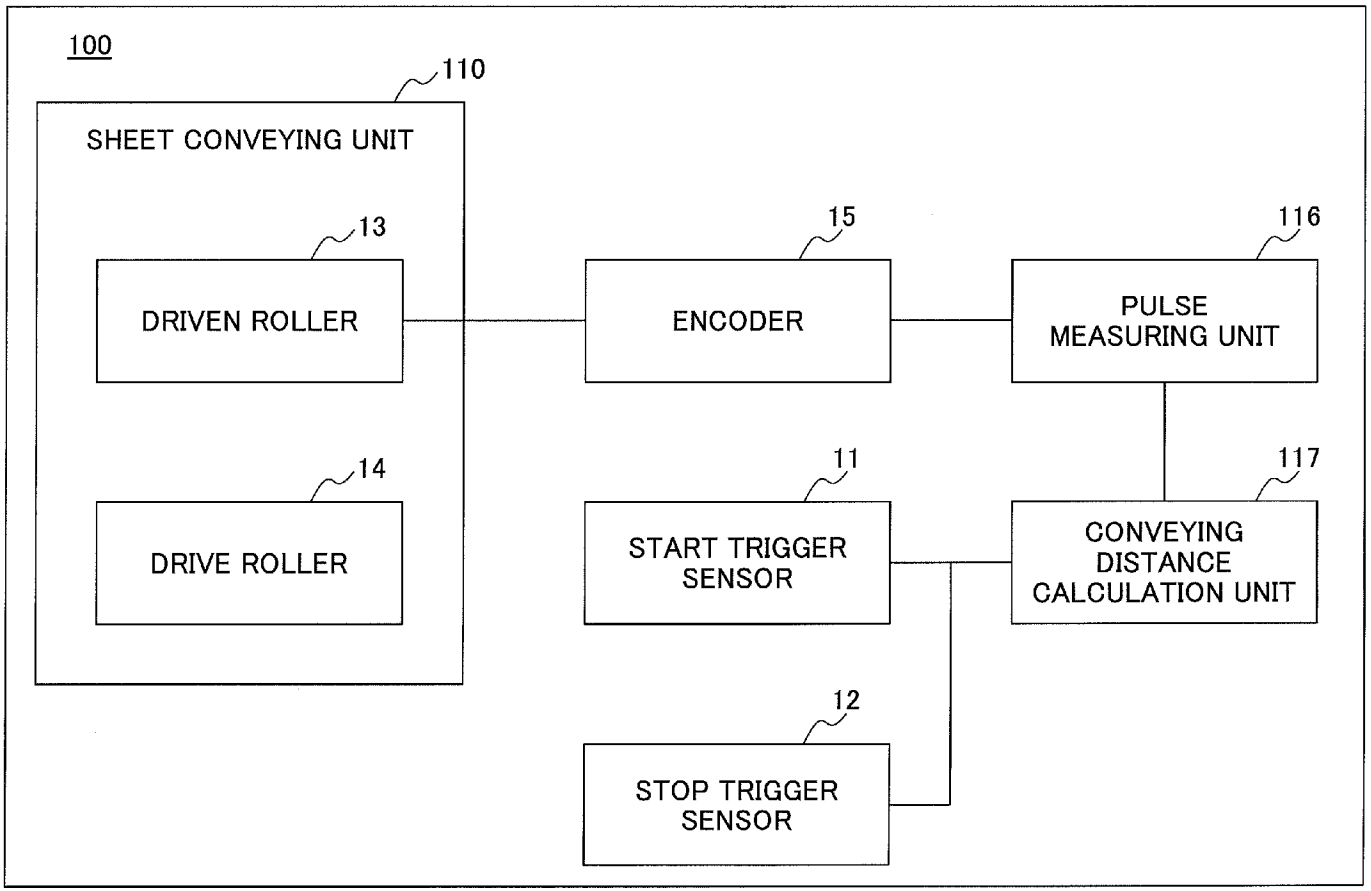
FIG. 3 is a block diagram showing an example of a functional structure of a sheet conveying apparatus of an embodiment.

FIG. 3 is a block diagram showing an example of a functional structure of the sheet conveying apparatus 100 of the embodiment.

As shown in FIG. 3, the sheet conveying apparatus 100 includes the sheet conveying unit 110 (the driven roller 13 and the drive roller 14), the rotary encoder 15, the start trigger sensor 11, the stop trigger sensor 12, a pulse measuring unit 116 and a conveying distance calculation unit 117. The structure of the sheet conveying apparatus 100 is explained with reference to FIG. 1 to FIG. 3.

The drive roller 14 includes an elastic layer at a surface in order to generate a sufficient friction force with the sheet S so that the sheet S becomes intervened between the drive roller 14 and the driven roller 13.

The driven roller 13 is provided to be pushed by a pushing member (not shown in the drawings) such as a spring or the like to be in contact with the drive roller 14. With this structure, when the drive roller 14 is rotated to convey the sheet S, the driven roller 13 is also rotated by the friction force generated with the sheet S.

The rotary encoder 15 is provided at a rotational axle of the driven roller 13 in this embodiment. The rotary encoder 15 includes an encoder disk 15*a* mounted on the rotational axle and an encoder sensor 15*b*. The encoder sensor 15*b* generates a pulse signal when the encoder disk 15*a* is being rotated with the driven roller 13.

The pulse measuring unit 116, which is an example of a conveying amount measuring unit, measures a rotation amount of the driven roller 13 as a conveying amount of the sheet S based on counting the pulse signal generated by the encoder sensor 15*b* in accordance with the rotation of the encoder disk 15*a*.

Alternatively, the rotary encoder 15 may be provided at a rotational axle of the drive roller 14, it means that the encoder disk 15*a* is mounted on the rotational axle. Further alternatively, the driven roller 13 and the drive roller 14 may be oppositely positioned.

The diameter of a roller (the driven roller 13 or the drive roller 14) to which the rotary encoder 15 is provided may be as small as possible so that the number of rotations of the roller in accordance with the conveying amount of the sheet S becomes larger to accurately measure the conveying distance of the sheet S.

The driven roller 13 or the drive roller 14 to which the rotary encoder 15 is provided may be made of metal in order to reduce deflection of the rotational axle. By reducing the deflection of the rotational axle, the conveying distance of the sheet S, which will be explained later, can be accurately measured.

As shown in FIG. 1, the width "Wr" of the driven roller 13 is set to be smaller than the minimum width "Ws" of an expected sheet S adaptable to the sheet, in a direction perpendicular to a conveying direction of the sheet S. Thus, when conveying the sheet S, the driven roller 13 does not directly contact the drive roller 14 so that the driven roller 13 can be rotated by the friction force generated with the sheet S. Therefore, the conveying distance of the sheet S can be accurately measured without being influenced by the drive roller 14.

The start trigger sensor 11 and the stop trigger sensor 12 are provided downstream and upstream, respectively, of the driven roller 13 and the drive roller 14 on a conveying path of the sheet S. The start trigger sensor 11 and the stop trigger sensor 12 are configured to detect passing of a front end portion (front edge) of the sheet S and passing of a rear end portion (rear edge) of the sheet, respectively. Each of the start trigger sensor 11 and the stop trigger sensor 12 may be a transmission or reflection optical sensor capable of detecting an end portion of the sheet S with high accuracy. In this embodiment, the start trigger sensor 11 and the stop trigger sensor 12 are reflection optical sensors.

The start trigger sensor 11 is an example of a downstream detection unit that detects passing of the front end portion of the sheet S. The stop trigger sensor 12 is an example of an upstream detection unit that detects passing of the rear end portion of the sheet S.

The start trigger sensor 11 and the stop trigger sensor 12 are positioned to be substantially at the same position in a direction perpendicular to the conveying direction of the sheet S. With this structure, it becomes possible to more precisely measure the conveying distance of the sheet S by minimizing the influence of the attitude of the sheet S (skew with respect to the conveyance direction).

Furthermore, the start trigger sensor 11 and the stop trigger sensor 12 are not necessarily positioned in the middle but may be positioned at an outer portion in the direction perpendicular to the conveying direction of the sheet S provided that they are positioned within the path of the sheet S.

In this embodiment, it is assumed that the distance between the start trigger sensor 11 and the driven roller 13 (or the drive roller 14) is "A", and the distance between the stop trigger sensor 12 and the driven roller 13 (or the drive roller 14) is "B", in the conveying direction of the sheet S. The distances "A" and "B" will be further explained later.

In this embodiment, it is assumed that the drive roller 14 is rotated in a direction shown by an arrow in FIG. 2. The driven roller 13 is rotated with respect to the drive roller 14 by the drive roller 14 when the sheet S is not conveyed (at an idling time) and by the sheet S when the sheet S is conveyed. When the driven roller 13 is rotated, the pulse signal is generated from the rotary encoder 15 provided at the rotational axle of the driven roller 13.

The pulse measuring unit 116 starts counting the number of pulses of the rotary encoder 15 based on the pulse signal when the start trigger sensor 11 detects passing of the front end portion of the sheet S, and stops counting the number of pulses of the rotary encoder 15 when the stop trigger sensor 12 detects passing of the rear end portion of the sheet S while the sheet S is being conveyed in a direction shown by an arrow X.

The conveying distance calculation unit 117 calculates the conveying distance of the sheet S by the sheet conveying unit 110 based on the detection of the sheet S by the start trigger sensor 11 and the stop trigger sensor 12, and the rotation amount of the driven roller 13 measured by the pulse measuring unit 116.

(Calculation of Conveying Distance of Sheet)

Figure 4:
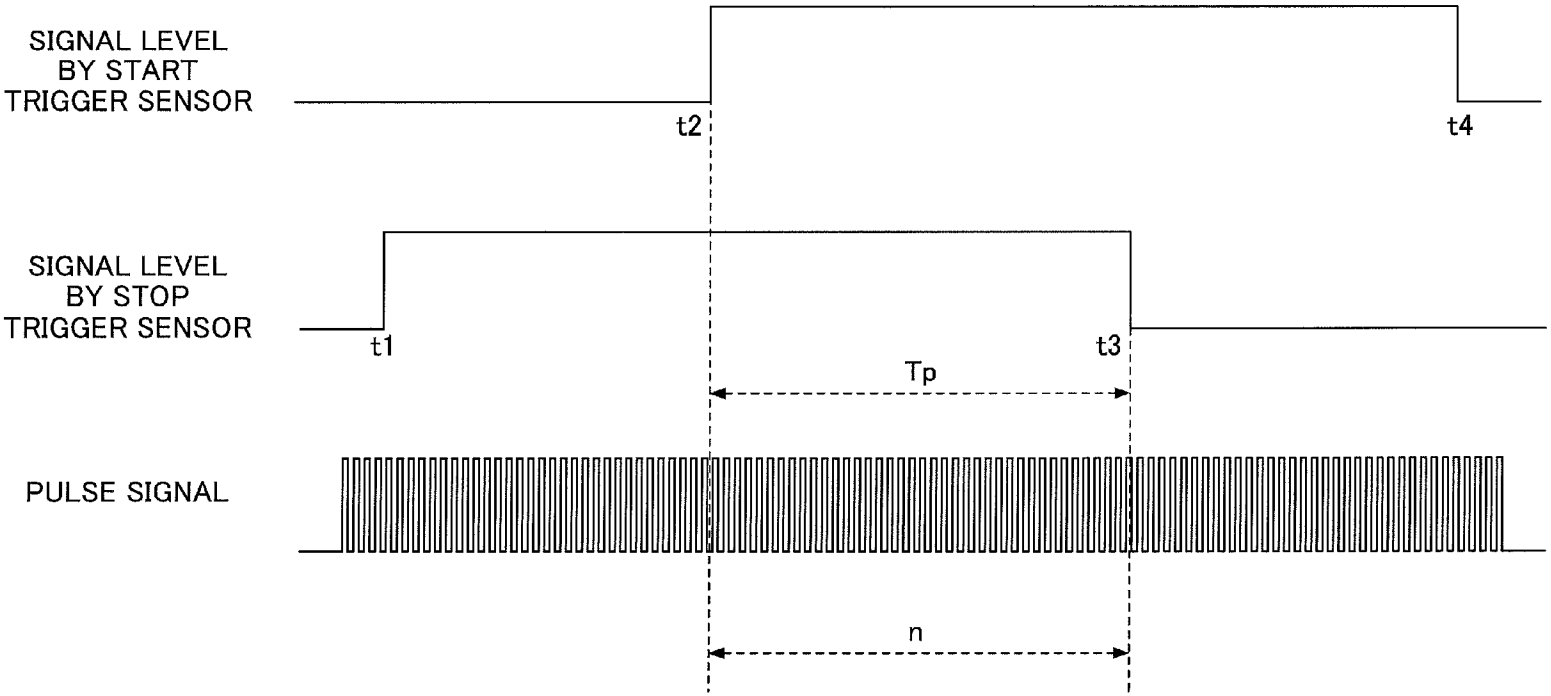
FIG. 4 is a view showing output signals output by a start trigger sensor, a stop trigger sensor and a rotary encoder.

FIG. 4 is a view showing output signals output by the start trigger sensor 11, the stop trigger sensor 12 and the rotary encoder 15.

As described above, when the driven roller 13 is rotated, the pulse signal is generated from the rotary encoder 15 which is provided at the rotational axle of the driven roller 13.

It is assumed that the stop trigger sensor 12 detects passing of a front end portion of the sheet S at time "t1" and after that, the start trigger sensor 11 detects passing of the front end portion of the sheet S at time "t2" while the sheet S is being conveyed.

Subsequently, it is assumed that the stop trigger sensor 12 detects passing of a rear end portion of the sheet S at time "t3" and after that, the start trigger sensor 11 detects passing of the rear end portion of the sheet S at time "t4".

The pulse measuring unit 116 counts the number of pulses of the rotary encoder 15 at a pulse counting period "Tp", which is from time "t2" at which the start trigger sensor 11 detects that the front end portion of the sheet S passes to time "t3" at which the stop trigger sensor 12 detects that the rear end portion of the sheet S passes.

Here, it is assumed that a radius of the driven roller 13 to which the rotary encoder 15 is provided is "r", the number of pulses of the rotary encoder 15 while the driven roller 13 is rotated 360 degrees is "N", and the number of pulses counted by the pulse measuring unit 116 during the pulse counting period "Tp" is "n". Under this condition, the sheet conveying distance "P" (see FIG. 1) of the sheet S during the pulse counting period "Tp" (from time "t2" to time "t3") is expressed by the following equation (1).

$$P=(n/N)\times 2\pi r \quad (1)$$

n: the counted number of pulses

N: the number of pulses of the rotary encoder 15 while the driven roller 13 is rotated 360 degrees r: radius [mm] of the driven roller 13

Generally, a sheet conveying speed is easily varied based on mechanical accuracy such as structural accuracy of the rollers (especially the drive roller 14) which convey the sheet S, deflection of rotational axle or the like, rotational accuracy of the motor or the like, or accuracy of the driving force transmitting unit such as a gear, a belt or the like. Further, the sheet conveying speed is varied based on a slipping phenomenon between the drive roller 14 and the sheet S, looseness generated by the difference in conveying force or conveying speed of conveying units provided upstream or downstream of the sheet conveying unit 110 or the like. Thus, a pulse period or pulse width of the rotary encoder 15 may always vary. However, the number of pulses does not easily vary.

Thus, the conveying distance calculation unit 117 can accurately obtain the sheet conveying distance "P" of the sheet S conveyed by the driven roller 13 and the drive roller 14 in accordance with the above equation (1), without depending on the sheet conveying speed.

The conveying distance calculation unit 117 can further obtain a relative ratio of the conveying distances of a previous sheet S and a next sheet S, a relative ratio of the conveying distances of a front surface of the sheet S and a back surface of the sheet or the like.

The conveying distance calculation unit 117 may obtain a ratio of expansion and contraction "R" based on a relative ratio of the conveying distances before and after the heat fixing by electrophotography in accordance with the following equation (2).

$$R=[(n2/N)\times 2\pi r]/[(n1/N)\times 2\pi r] \quad (2)$$

n1: the number of pulses measured when the sheet S before the heat fixing is conveyed n2: the number of pulses measured when the sheet S after the heat fixing is conveyed Examples are explained in the following.

In this embodiment, when the measured number of pulses is n1=18816 under a condition that N=2800, r=9 mm and the sheet S of A3 size is conveyed in the longitudinal direction, the conveying distance "P1" of the sheet S becomes, $$P1=(18816/2800)\times 2\pi\times 9=380.00 \text{ mm}$$

Further, when the measured number of pulses is n2=18759 after the heat fixing of the sheet S, the conveying distance "P2" of the sheet S becomes, $$P2=(18759/2800)\times 2\pi\times 9=378.86 \text{ mm}$$

Thus, the difference between before and after the heat fixing ΔP of the conveying distances "P1" and "P2" of the sheet S becomes as follows.

$$\Delta P=380.00-378.86=1.14 \text{ mm}$$

Thus, the ratio of expansion and contraction "R" (the relative ratio between before and after the heat fixing (front side surface and back side surface of the sheet S, respectively)) of the sheet S may be obtained as follows.

$$R=378.86/380.00=99.70\%$$

Thus, in this case, the length of the sheet S in the conveying direction of the sheet S is shrunken about 1 mm by the heat fixing. Therefore, if the lengths of the images to be formed on the front surface and the back surface of the sheet S are the same, registration error between two surfaces of about 1 mm is generated. Thus, by correcting the length of the image printed on the back surface of the sheet S based on the calculated ratio of expansion and contraction "R", the registration in two-sided printing can be improved.

Here, for the above described example, the ratio of expansion and contraction "R" is obtained by calculating the conveying distances "P1" and "P2" of the sheet S before and after the heat fixing. Alternatively, the ratio of expansion and contraction "R" may be calculated based on the numbers of pulses "n1" and "n2" which are counted by the pulse measuring unit 116 such as R=n2/n1.

For the above example, when the number of pulses $n_1$, which is measured when the sheet S is conveyed before the heat fixing, is n1=18816, and the number of pulses n2, which is measured when the sheet S is conveyed after the heat fixing, is $n_2$=18759, the ratio of expansion and contraction "R" may be obtained as follows.

$$R=n2/n1=18759/18816=99.70\%$$

Here, by adding a distance "a" between the start trigger sensor 11 and the stop trigger sensor 12 shown in FIG. 2 to the sheet conveying distance "P" obtained by the above equation (1), the length "L" of the sheet S in the conveying direction becomes as follows.

$$L=(n/N)\times 2\pi r+a \quad (1')$$

a: the distance between the start trigger sensor 11 and the stop trigger sensor 12

The conveying distance calculation unit 117 of the sheet conveying apparatus 100 can obtain the length "L" of the sheet S in the conveying direction based on the equation (1') in which the distance "a" between the start trigger sensor 11 and the stop trigger sensor 12 is added to the conveying distance "P" of the sheet S obtained based on the above equation (1).

Further, the conveying distance calculation unit 117 can obtain the ratio of expansion and contraction "R" from the relative ratio of the length "L" of the sheet S in the conveying direction before and after the heat fixing by the electrophotography in accordance with the following equation (2').

$$R=[(n2/N)\times 2\pi r+a]/[(n1/N)\times 2\pi r+a] \quad (2')$$

As described above, the conveying distance calculation unit 117 of the sheet conveying apparatus 100 can accurately obtain the length "L" of the sheet S in the conveying direction and the ratio of expansion and contraction "R".

(Relationship Between Perimeter of Driven Roller and Measuring Length of Sheet)

Figure 5A:
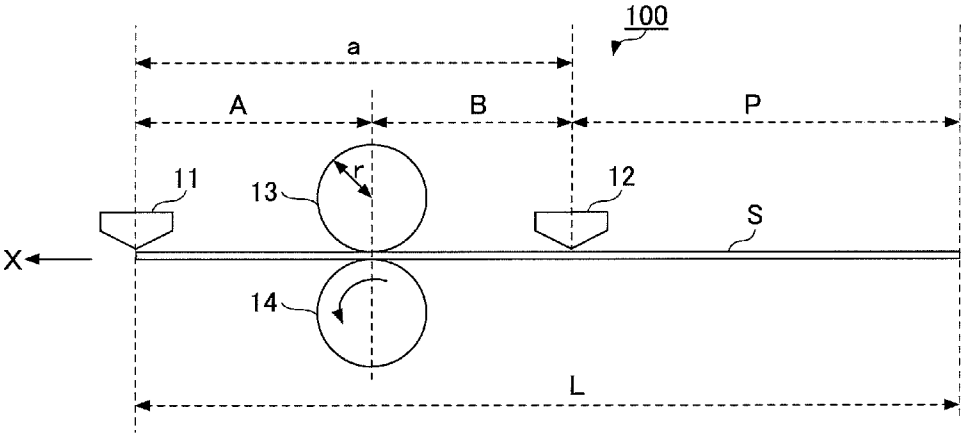
FIG. 5A and FIG. 5B are views for explaining a conveying distance "P" of a sheet of an embodiment.
Figure 5B:
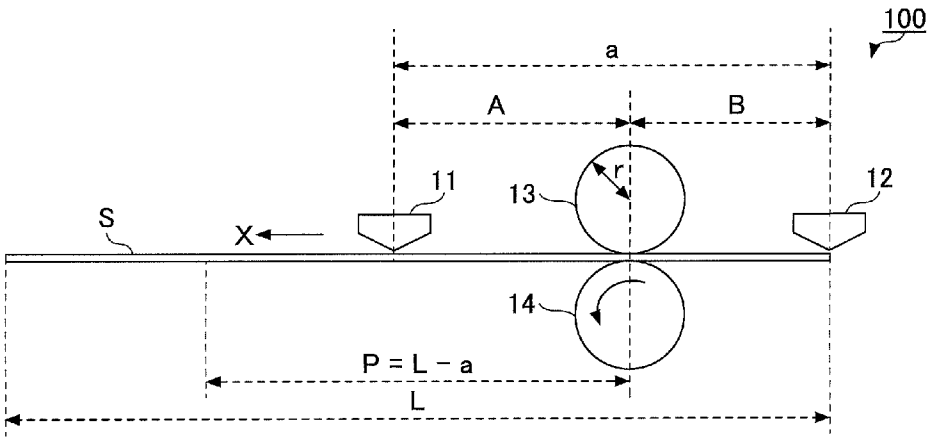

FIG. 5A and FIG. 5B are views for explaining the conveying distance "P" of the sheet S, at which the pulses are counted, in the sheet conveying apparatus 100 of the first embodiment.

As shown in FIG. 5A, the rotary encoder 15, which is provided at the driven roller 13 although not shown in FIG. 5A, starts counting pulses when a front end portion of the sheet S is detected by the start trigger sensor 11.

When the sheet S is conveyed by the drive roller 14 and the driven roller 13 and a rear end portion of the sheet S is detected by the stop trigger sensor 12 at a position as shown in FIG. 5B, the rotary encoder (although not shown in FIG. 5) stops counting the pulses.

The conveying distance "P" is a conveying amount of the sheet S conveyed by the drive roller 14 and the driven roller 13 within a pulse counting range, which is between a start timing when the sheet S is detected by the start trigger sensor 11 and counting of the pulses is started, and an end timing when the sheet S is detected by the stop trigger sensor 12 and counting of the pulses is stopped.

Specifically, the conveying distance "P" becomes a length obtained by subtracting a distance "A" between the start trigger sensor 11 and the driven roller 13 and a distance "B" between the driven roller 13 and the stop trigger sensor 12 from the length "L" of the sheet S in the conveying direction (P=L−(A+B)). In other words, the conveying distance "P" becomes P=L—a which is obtained by subtracting a distance "a" between the start trigger sensor 11 and the stop trigger sensor 12 from the length "L" of the sheet S.

Figure 6A:
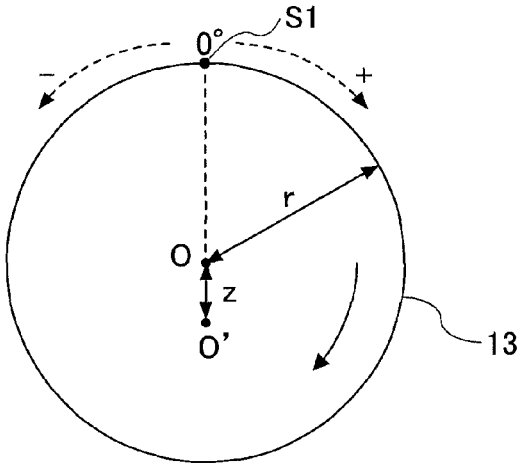
FIG. 6A and FIG. 6B are views for explaining a relationship between the eccentric amount of a driven roller and a measurement error of an embodiment.
Figure 6B:
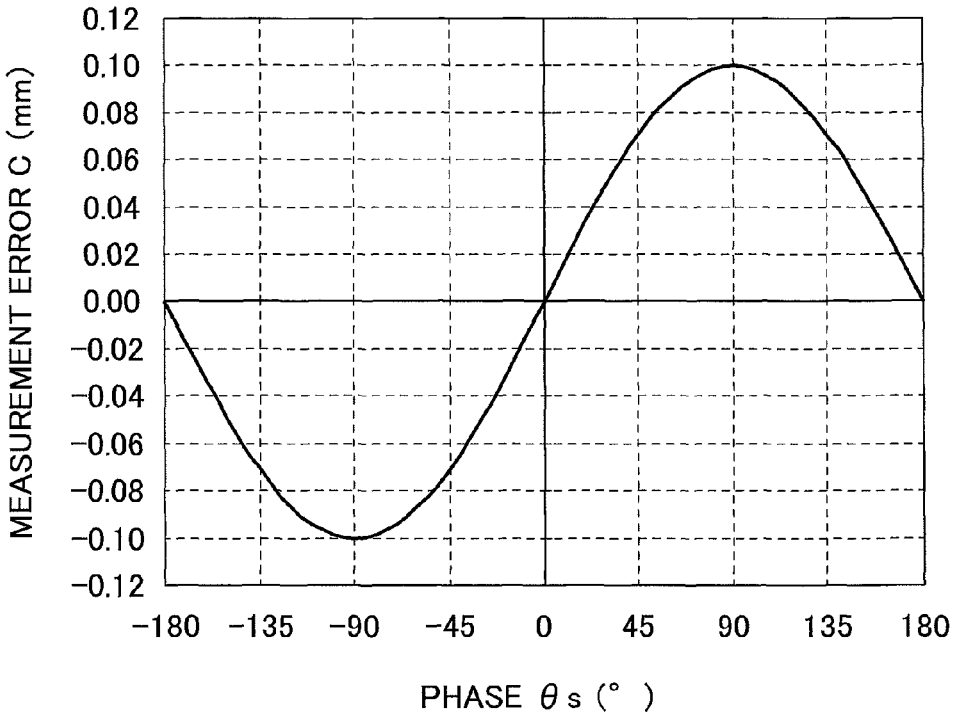

FIG. 6A and FIG. 6B are views for explaining a relationship between an eccentric amount of the driven roller 13 of the first embodiment and a measurement error in the conveying distance "P" of the sheet S.

For example, as shown in FIG. 6A, it is assumed that the driven roller 13, to which the rotary encoder 15 is provided, is rotated around an eccentric center O' which is decentered for "z" from the center O of its circumferential circle. At this time, a measurement error "C" in the conveying distance "P" of the sheet S can be calculated as follows.

$$C=\sin\theta s\times z \quad (3)$$

Here, "θs" is phase of the driven roller 13 when a point S1 at which the measuring of the conveying amount is started is defined as θs=0.

FIG. 6B shows the measurement error "C" when z=−0.1 mm. It means that if the phases of the driven roller 13 at the start timing and the end timing are different from each other, and the eccentric amount z=−0.1 mm, the measurement error "C" becomes ±0.1 mm at the maximum.

Thus, in this embodiment, the radius "r" of the driven roller 13 to which the rotary encoder 15 is provided and the distance "a" between the start trigger sensor 11 and the stop trigger sensor 12 are determined to satisfy the following equation (4). In the following equation (4), "Ls" is a set length of an expected sheet (which will be referred to as the expected sheet Se hereinafter) for which the actual length "L" is to be measured by the sheet conveying apparatus 100, and "Pe" is an expected value of the conveying distance (simply referred to as the "expected conveying distance" hereinafter) of the expected sheet Se.

$$Pe(=Ls-a)=2\pi r\times k \quad (4)$$

k: positive integer

It means that according to the embodiment, the radius "r" of the driven roller 13 or the distance "a" between the start trigger sensor 11 and the stop trigger sensor 12 is determined such that the expected conveying distance "Pe" becomes an integer multiple of a perimeter of the driven roller 13. With this structure, the phases of the driven roller 13 at the start timing and the end timing are expected to become substantially the same to reduce the measurement error "C".

FIG. 7 is a view showing an example of a relationship between the set length "Ls" of the expected sheet Se in the conveying direction, the expected conveying distance "Pe", and the perimeter "2πr" of the driven roller 13 in the embodiment.

Thus, for a case when the radius "r" of the driven roller 13 is previously fixed, the distance "a" between the start trigger sensor 11 and the stop trigger sensor 12 is determined to satisfy the following equation (4-1).

$$a=Ls-(2\pi r\times k) \quad (4\text{-}1)$$

Further, for a case when the distance "a" between the start trigger sensor 11 and the stop trigger sensor 12 is previously fixed, the perimeter "2πr" (or the radius "r") of the driven roller 13 is determined to satisfy the following equation (4-2).

$$2\pi r=(Ls-a)/k \quad (4\text{-}2)$$

For example, it is assumed that the distance "a" between the start trigger sensor 11 and the stop trigger sensor 12 is previously fixed as 70 mm. Further, it is assumed that two kinds of sheets are expected to be used in the sheet conveying apparatus 100, whose set lengths "Ls" are 210 mm (a case when A4 sheet is conveyed in the lateral direction is assumed) and 420 mm (a case when A3 sheet is conveyed in the longitudinal direction is assumed), which are most commonly used in Japan. In this case, the expected conveying distances "Pe" for these expected sheets Se become 140 mm and 350 mm, respectively.

Thus, the driven roller 13 is determined to have the perimeter "2πr" selected from among 2 mm, 4 mm, 5 mm, 7 mm, 10 mm, 14 mm, 20 mm, 28 mm, 35 mm and 70 mm, which are common divisors of the expected conveying distances "Pe" for both the expected sheets Se based on the necessity. For example, when the perimeter 2πr=70 mm is selected, the radius "r" becomes about 11.14 mm.

With this structure, for the both expected sheets Se having the set lengths "Ls" 210 mm and 420 mm, the expected conveying distances "Pe" become an integer multiple of the perimeter of the driven roller 13. Thus, the measurement error "C" caused by the eccentric amount of the driven roller 13 can be reduced.

As described above, it is desirable to have the expected conveying distance "Pe" become an integer multiple of the perimeter of the driven roller 13. However, a predetermined margin may be provided based on an allowable measurement error "$C_a$".

Thus, in this embodiment, the radius "r" of the driven roller 13 or the distance "a" between the start trigger sensor 11 and the stop trigger sensor 12 may be determined such that the expected conveying distance "Pe" becomes a substantially integer multiple of a perimeter of the driven roller 13 as follows.

$$Pe(=Ls-a)=2\pi r\times k' \quad (4')$$

Here, "k'" is a substantially positive integer determined based on an allowable measurement error "$C_a$" as follows.

An example when the radius "r" of the driven roller 13 is previously fixed will be explained.

It is assumed that the eccentric amount "z" of the driven roller 13 is 0.1 mm. Further, if an allowable measurement error "$C_a$" in the conveying distance "P" of the sheet S is ±0.02 mm, an allowable phase "$\theta s_a$" of the driven roller 13 is calculated as follows based on the above equation (3).

$$\pm C_a=\sin\theta s_a\times z$$

$$\sin\theta s_a=\pm C_a/z=\pm 0.02/0.1$$

$$\theta s_a=\pm 11.54$$

Figure 8:
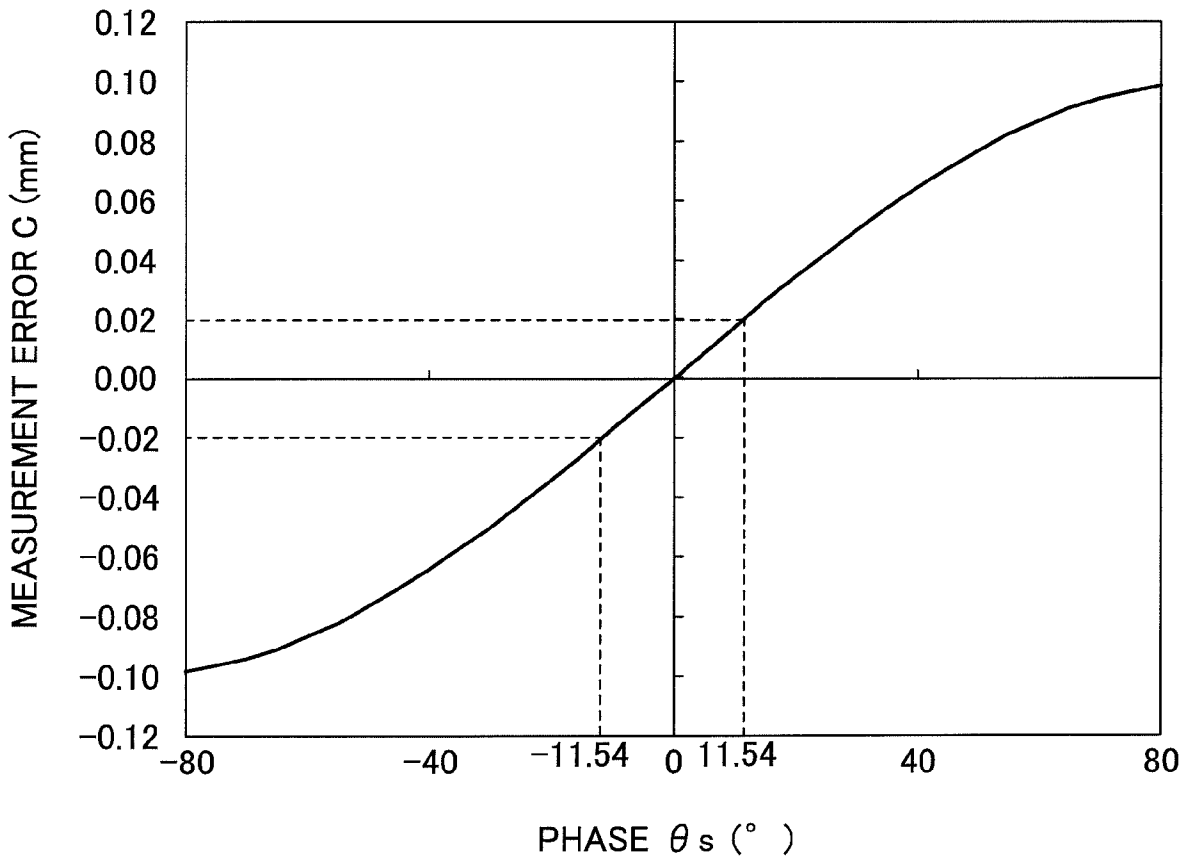
FIG. 8 is a graph showing a relationship between measurement error "C" and phase "θs" of a driven roller of an embodiment.

FIG. 8 shows a relationship between the measurement error "C" and the phase "θs" of the driven roller 13 of the embodiment. It means that the measurement error "C" becomes within ±0.02 mm when the phases "θs" of the driven roller 13 at the start timing and the end timing are within ±11.54°. Thus, the allowable phase "$\theta s_a$" becomes ±11.54° when the allowable measurement error "$C_a$" is ±0.02 mm.

Provided that the perimeter of the driven roller 13 is 70 mm, when the driven roller 13 is rotated ±11.54°, which is the allowable phase "$\theta s_a$", the conveying amount of the sheet S becomes ±2.244 mm as follows.

$$2\pi r\times(\theta s/360)=70\times(\pm 11.54/360)=\pm 2.244\text{ mm}$$

The above means that an allowable margin in the distance "$a_a$" becomes ±2.244 mm. Thus, an allowable distance "$a_a$" between the start trigger sensor 11 and the stop trigger sensor 12 can be obtained as follows by adding the above distance "±2.244 mm" to the distance "a" obtained based on the above equation (4-1). Here, it is assumed that the set length "Ls" of the expected sheet Se is 210 mm (a case when A4 sheet is conveyed in the lateral direction is supposed), and k=2.

$$\begin{aligned} a_a &= Ls-(2\pi r\times k)\pm 2\pi r(\theta s/360) \\ &= 210-(70\times 2)\pm 2.244 \\ &= 70\pm 2.244 \end{aligned}$$

Thus, when the perimeter of the driven roller 13 is 70 mm, the eccentric amount "z" of the driven roller 13 is less than or equal to 0.1 mm, and k=2, the allowable distance "$a_a$" becomes 70±2.244 mm in order to meet the allowable measurement error "$C_a$" to be ±0.02 mm.

Thus, in the equation (4'), "k'" can be expressed as follows.

$$k'=k\pm(\theta s_a/360)$$

The sheet conveying unit 110 may further include a relation information storing unit as will be explained later that stores the relationship between the measurement error "C" and the phase "θs" of the driven roller 13 as shown in FIG. 8. In such a case, the value of "k'" may be obtained using the relationship stored in the relation information storing unit based on the allowable measurement error "$C_a$". Further, the value of "k'" may be calculated as follows based on the allowable measurement error "$C_a$". The allowable measurement error "$C_a$" may be determined based on the set length "Ls", the kind of the conveying apparatus 100, an expected value of the ratio of expansion and contraction "R", or the like, but may be ±0.05 mm as an example.

Based on the above described equation (3), θs can be expressed as follows.

$$\theta s=\sin^{-1}(C/z)$$

Thus, "k'" can be expressed as follows.

$$k'=k\pm 2\pi r(\sin^{-1}(C_a/z)/360)$$

As described above, in this embodiment, the distance "a" between the start trigger sensor 11 and the stop trigger sensor 12 or the perimeter "2πr" of the driven roller 13 is determined as follows.

Figure 16:
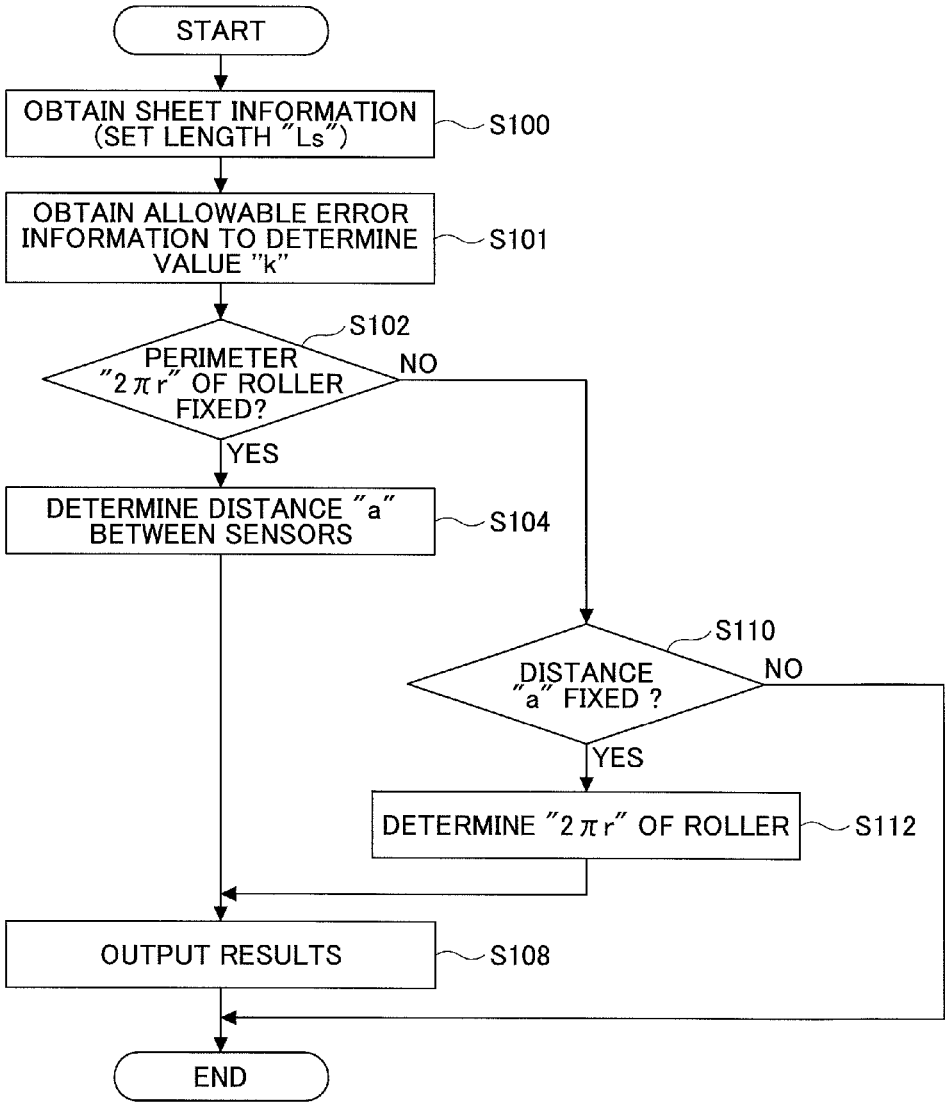
FIG. 16 is a flow chart showing an example of operations of determining a distance "a" or a perimeter "2πr"

FIG. 16 is a flowchart showing an example of operations of determining the distance "a" or the perimeter "2πr". This operation may be performed by the conveying distance calculation unit 117.

First, sheet information including set lengths "Ls1", "Ls2", . . . and "Lsn" of expected sheets Se1, Se2, . . . and Sen in the conveying direction are obtained (step S100).

Subsequently, allowable error information is obtained to determine the value "k'" (step S101).

Then, if the perimeter "2πr" (or the radius "r") of the driven roller 13 is previously fixed (YES in step S102), the distance "a" is determined based on the equation (4') (step S104). Subsequently, calculated result is output from the conveying distance calculation unit 117 (step S108).

At step S102, if the perimeter "2πr" (or the radius "r") of the driven roller 13 is not previously fixed (NO in step S102), and the distance "a" is previously fixed (YES in step S110), the perimeter "2πr" (or the radius "r") of the driven roller 13 is determined based on the equation (4') (step S112). Then, calculated result is output from the conveying distance calculation unit 117 (step S108).

As described above, by determining the distance "a" between the start trigger sensor 11 and the stop trigger sensor 12 or the perimeter "2πr" of the driven roller 13 such that the expected conveying distance "Pe" becomes a substantially integer multiple of a perimeter of the driven roller 13, influence of the eccentric amount of the driven roller 13 is reduced so that the conveying distance "P" of the sheet S in the conveying distance can be accurately measured.

When the distance "a" is to be determined is previously known, step S102 can be omitted and only steps S100 and S101, and steps S104 and S108 are performed. Similarly, when the perimeter "2πr" is to be determined is previously known, steps S102 and S110 can be omitted and only steps S100 and S101, and steps S112 and S108 are performed.

Figure 17:
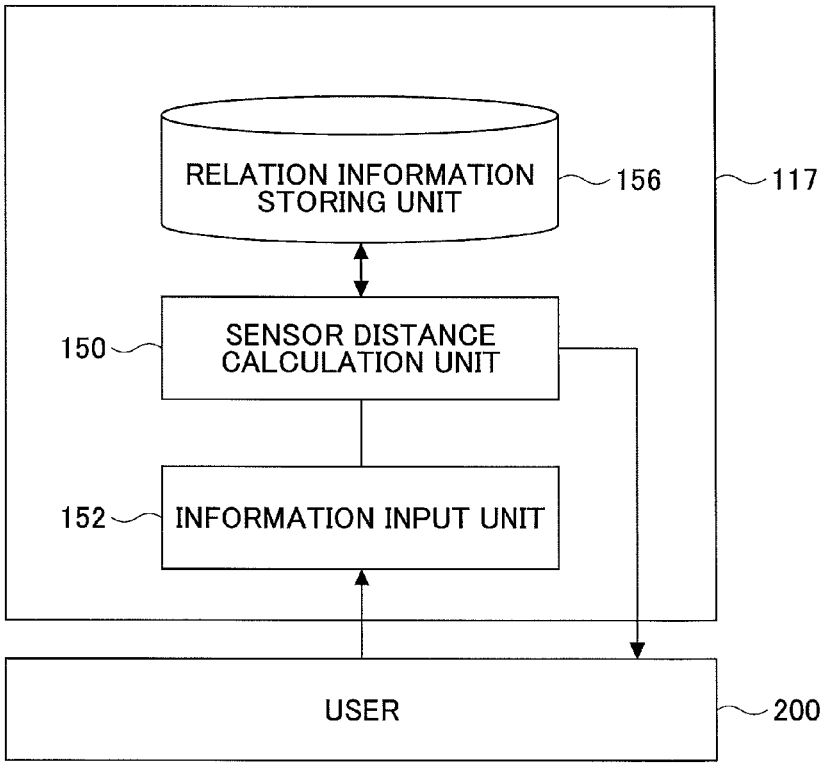
FIG. 17 is a block diagram showing an example of functional components of a conveying distance calculation unit.

FIG. 17 is a block diagram showing an example of the functional components of the conveying distance calculation unit 117. Functional components of the conveying distance calculation unit 117 for calculating the conveying distance of the sheet S by the sheet conveying unit 110 based on the detection of the sheet S by the start trigger sensor 11 and the stop trigger sensor 12, and the rotation amount of the driven roller 13 measured by the pulse measuring unit 116 are not shown in FIG. 17. The conveying distance calculation unit 117 includes an information input unit 152, a sensor distance calculation unit 150 and a relation information storing unit 156.

The information input unit 152 inputs information input by a user 200 or the like. The information input unit 152 may input the sheet information explained above with reference to step S100 in FIG. 16 input by the user 200 or the like. Further, the information input unit 152 may input the allowable error information explained above with reference to step S101 in FIG. 16 input by the user 200 or the like. Further, if the perimeter "2πr" (or the radius "r") of the driven roller 13 is previously fixed, the information input unit 152 may input the value "2πr" (or the radius "r") input by the user 200 or the like. On the contrary, if the distance "a" is previously fixed, the information input unit 152 may input the value "a" input by the user 200 or the like.

If the perimeter "2πr" (or the radius "r") of the driven roller 13 is previously fixed, the sensor distance calculation unit 150 may calculate the distance "a" as explained above with reference to step S104 in FIG. 16. The relation information storing unit 156 stores the relationship between the measurement error "C" and the phase "θs" of the driven roller 13 as shown in FIG. 8. At this time, the sensor distance calculation unit 150 may refer to the relation information storing unit 156 for obtaining the allowable phase "$\theta s_a$" based on the allowable measurement error "$C_a$". Further, if the distance "a" is previously fixed, the sensor distance calculation unit 150 may calculate the perimeter "2πr" (or the radius "r") of the driven roller 13 as explained above with reference to step S112 in FIG. 16.

Although in the above embodiment, an example where the rotary encoder 15 is attached to the driven roller 13 is explained, the rotary encoder 15 may be attached to the drive roller 14. In this case, the radius of the drive roller 14 or the distance "a" between the start trigger sensor 11 and the stop trigger sensor 12 is determined such that the expected conveying distance "Pe" becomes a substantial integer multiple of a perimeter of the drive roller 14. With this structure, a measurement error caused by eccentric of the drive roller 14 can be reduced.

Further, the distance "a" between the start trigger sensor 11 and the stop trigger sensor 12 may be arbitrary determined based on the radius "r" of the driven roller 13, sizes of the start trigger sensor 11 and the stop trigger sensor 12, or a space in the sheet conveying apparatus 100 or the like.

Further, the driven roller 13 (or the drive roller 14) may be configured to be capable of changing the perimeter. In this case, the driven roller 13 (or the drive roller 14) may be configured to have plural perimeters which are varied stepwise. In this case, the driven roller 13 (or the drive roller 14) is positioned to face the drive roller 14 (or the driven roller 13) at the edge side in the width direction of the sheet and hold a sheet there between. In this case, the driven roller 13 (or the drive roller 14) may be configured to be capable of moving toward and away from the drive roller 14 (or the driven roller 13) as well as in the width direction of the sheet.

Thus, in this embodiment, by determining the distance "a" between the start trigger sensor 11 and the stop trigger sensor 12 or the perimeter "2πr" of the driven roller 13 to be within a predetermined range, the measurement error "C" can be reduced to be a predetermined value.

Second Embodiment

In this embodiment, a case when the perimeter "2πr" (or the radius "r") of the driven roller 13 is previously fixed, in other words, the driven roller 13 is previously fixed, is explained.

The sheet conveying apparatus 100 may be configured to include plural sensors for at least one of the start trigger sensor and the stop trigger sensor.

As described above, when the set lengths "Ls" of the expected sheets Se are 210 mm (a case when A4 sheet is conveyed in the lateral direction is supposed) or 420 mm (a case when A3 sheet is conveyed in the longitudinal direction is supposed), the distance "a" or the perimeter of the driven roller 13 can be obtained based on the common divisor of the expected conveying distances "Pe" as shown in FIG. 7. Thus, in such a case, the conveying distance "P" of the sheet S can be accurately measured by setting the distance "a" and the perimeter of the driven roller 13 to satisfy the above described equation (4), (4') or the like.

However, there may be a case when there are no common divisors of the expected conveying distances "Pe" for the expected sheets Se. Thus, in this embodiment, plural sensors for at least one of the start trigger sensor and the stop trigger sensor are provided.

Figure 9:
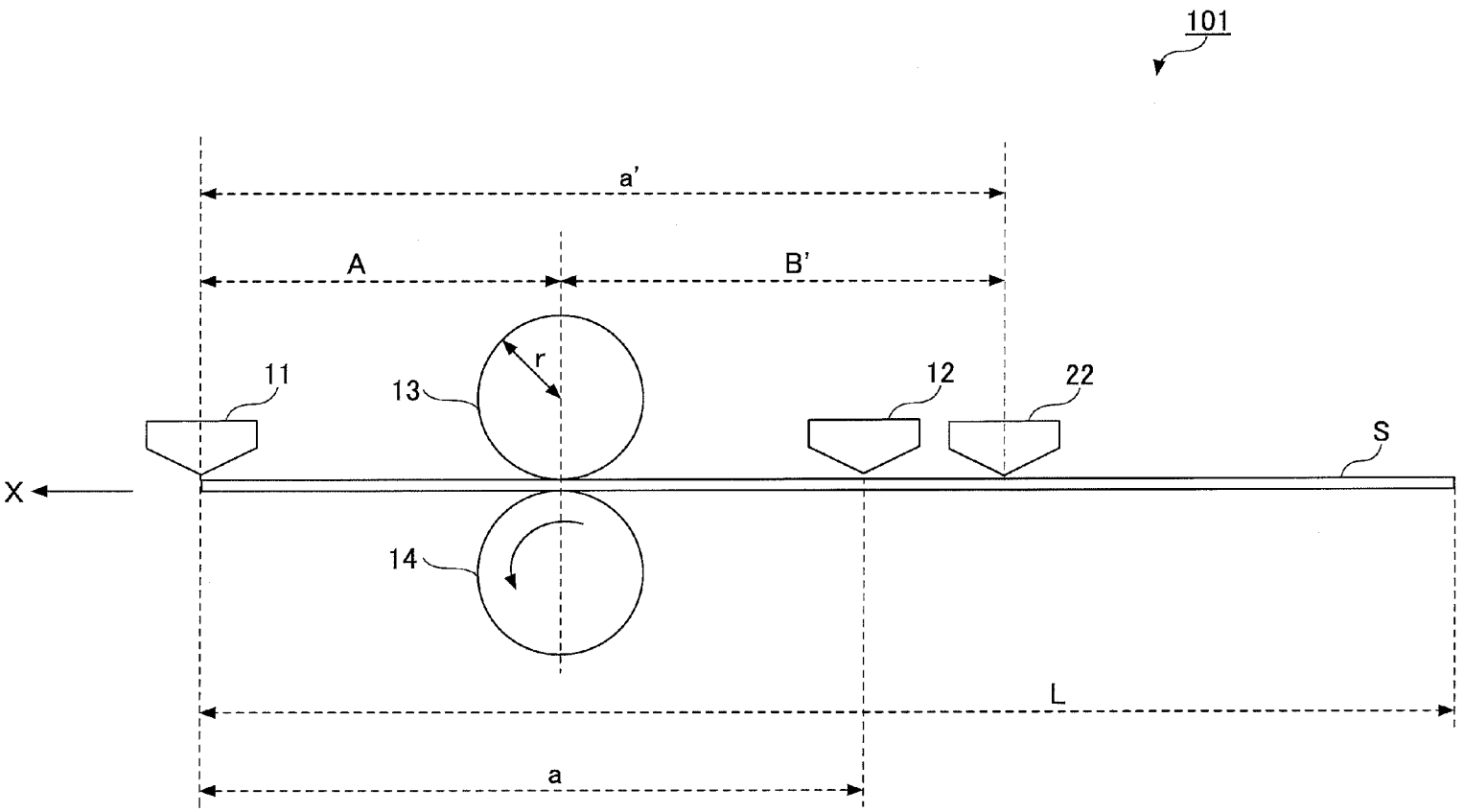
FIG. 9 is a schematic diagram showing an example of a sheet conveying apparatus of an embodiment.

FIG. 9 is a schematic diagram showing an example of a sheet conveying apparatus 101 of the embodiment. In this embodiment, the sheet conveying apparatus 101 includes plural stop trigger sensors.

The sheet conveying apparatus 101 of the embodiment further includes a stop trigger sensor 22 in addition to the components of the sheet conveying apparatus 100 of the first embodiment explained above with reference to FIG. 1 to FIG. 3.

The sheet conveying apparatus 101 is configured to be adaptable for a LETTER size sheet as the expected sheet Se, which is commonly used in North America or the like and whose set length "Ls" is 216 mm (a case when it is conveyed in the lateral direction is supposed) in addition to 210 mm (a case when A4 sheet is conveyed in the lateral direction is supposed) or 420 mm (a case when A3 sheet is conveyed in the longitudinal direction is supposed).

Thus, in this embodiment, similar to the first embodiment, the start trigger sensor 11 and the stop trigger sensor 12 are provided such that the expected conveying distances "Pe" obtained by subtracting the distance "a" between the start trigger sensor 11 and the stop trigger sensor 12 from the set lengths 210 mm and 420 mm, respectively becomes a substantially integer multiple of the perimeter of the driven roller 13.

Further, in this embodiment, the start trigger sensor 11 and the stop trigger sensor 22 are provided such that the expected conveying distances "Pe" obtained by subtracting the distance "a'" between the start trigger sensor 11 and the stop trigger sensor 22 from the set length 216 mm becomes a substantially integer multiple of the perimeter of the driven roller 13.

Thus, according to the embodiment, even when there are no common divisors of the expected conveying distances "Pe" for the expected sheets Se, by providing plural combinations of the start trigger sensor and the stop trigger sensor, the distances of which are different from each other, the conveying distance "P" of various kinds of sheets can be accurately calculated.

Alternatively, the sheet conveying apparatus 100 may be configured to include plural start trigger sensors, or plural start trigger sensors and plural stop trigger sensors. Thus, in this embodiment, plural sensors for at least one of the start trigger sensor and the stop trigger sensor are provided.

In this embodiment, the conveying distance calculation unit 117 selects a combination of the start trigger sensor 11 and the stop trigger sensor 12 or a combination of the start trigger sensor 11 and the stop trigger sensor 22 based on the set lengths "Ls" of the expected sheets "Se". Then, the conveying distance calculation unit 117 calculates the conveying distance "P" based on the selected combination of the start trigger sensor and the stop trigger sensor.

With this structure, the sheet conveying distance "P" or the length "L" of the sheet S can be accurately measured. Thus, the measurement error "C" caused by the eccentric amount of the driven roller 13 is reduced and for the distances which are different from each other, the conveying distance "P" of various kinds of sheets can be accurately calculated.

The start trigger sensor 11 and the stop trigger sensors 12 and 22 may be positioned on a line extending in the conveying direction of the sheet S, in other words, the start trigger sensor 11 and the stop trigger sensors 12 and 22 may be positioned to be substantially at the same position in a direction perpendicular to the conveying direction of the sheet S. Alternatively, the start trigger sensor 11 and the stop trigger sensors 12 and 22 may be positioned at different positions in the direction perpendicular to the conveying direction of the sheet S as shown in FIG. 10.

Figure 10:
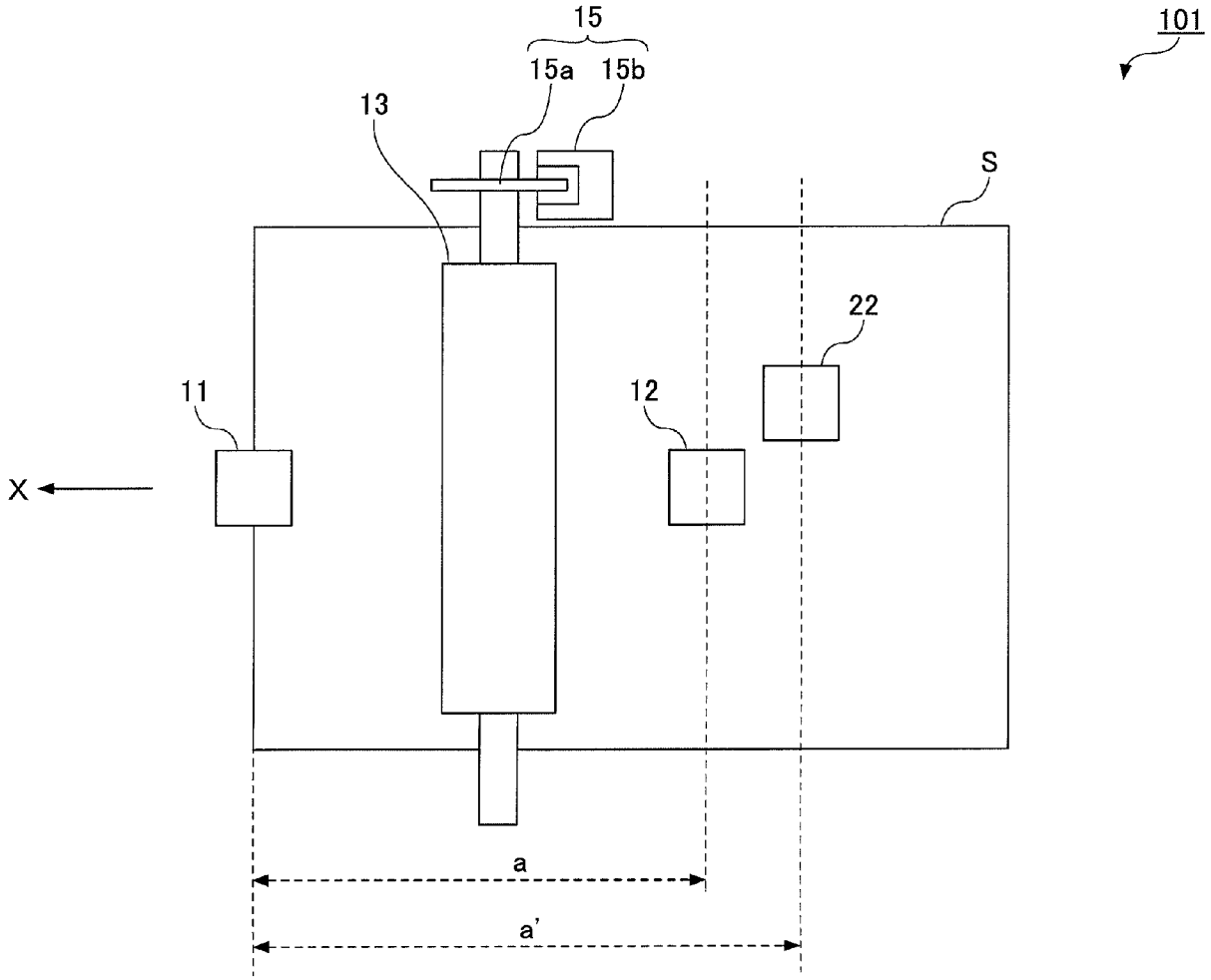
FIG. 10 is a plan view schematically showing an example of a structure of a sheet conveying apparatus of an embodiment.

FIG. 10 is a plan view schematically showing an example of a structure of the sheet conveying apparatus 101 of the embodiment. In this example, the stop trigger sensors 12 and 22 are positioned at different positions in the direction perpendicular to the conveying direction of the sheet S. With this structure, interference between the stop trigger sensors 12 and 22 can be avoided.

Third Embodiment

In this embodiment as well, a case when the perimeter "2πr" (or the radius "r") of the driven roller 13 is previously fixed, in other words, the driven roller 13 is previously fixed, is explained.

In this embodiment, at least one of the start trigger sensor 11 and the stop trigger sensor 12 may be provided to be movable in the conveying direction of the sheet S to correspond to various sizes of the sheets.

Figure 11:
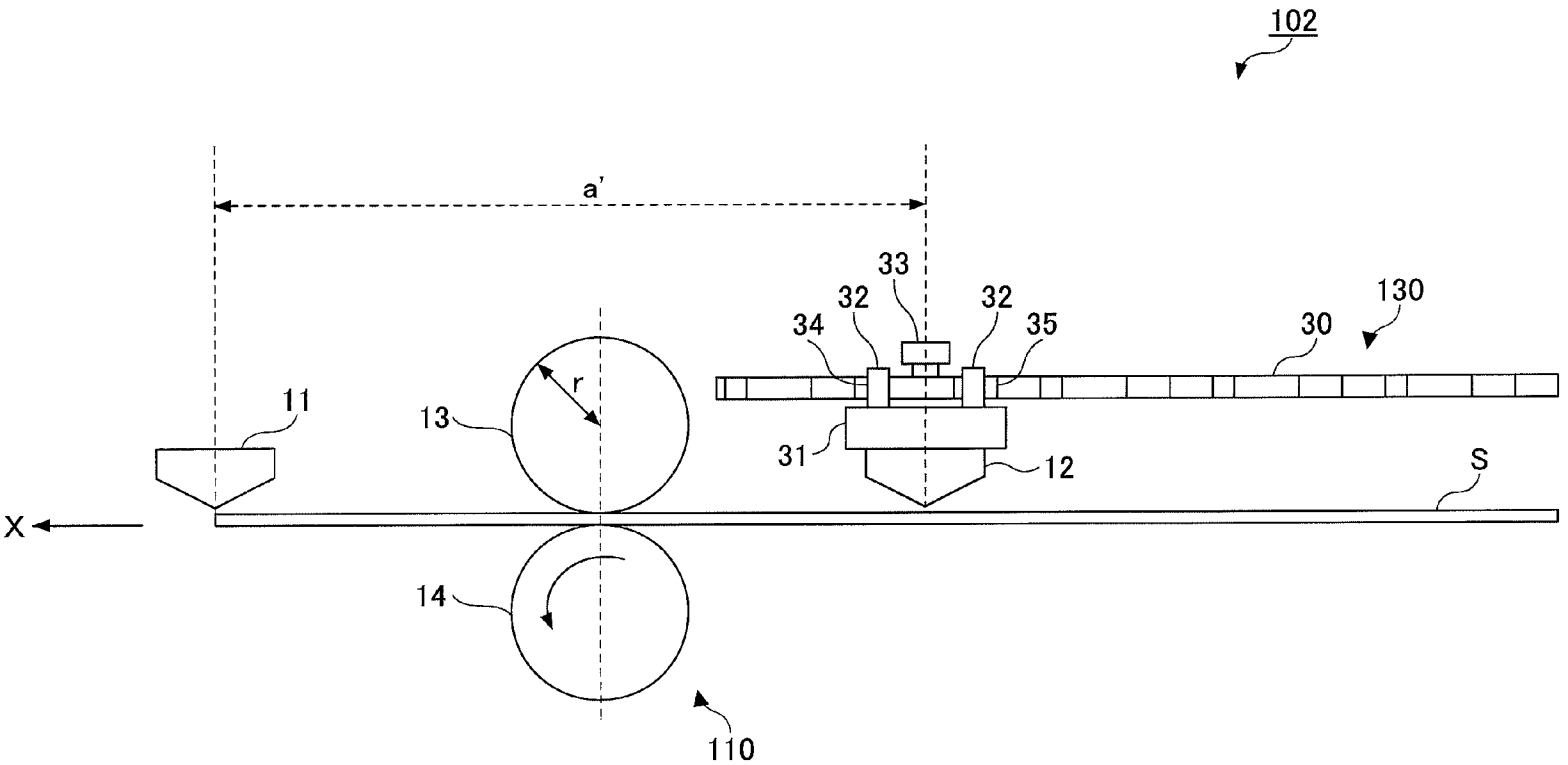
FIG. 11 is a schematic diagram showing an example of a sheet conveying apparatus of an embodiment.

FIG. 11 is a schematic diagram showing an example of a sheet conveying apparatus 102 of the embodiment.

The sheet conveying apparatus 102 of the embodiment further includes a sensor position adjusting unit 130 that adjusts the position of the stop trigger sensor 12 in the conveying direction of the sheet S.

The sensor position adjusting unit 130 includes a sensor support member 30 provided with plural locating holes 34 and plural long holes 35, a bracket 31 provided with two protruding portions 32, and a screw 33 with knob.

The stop trigger sensor 12 is attached to the bracket 31 to be supported by the sensor support member 30.

When the protruding portions 32 of the bracket 31 engage one of the locating holes 34 and one of the long holes 35, respectively, and fixed by the screw 33, the bracket 31 is fixed to the sensor support member 30.

The plural locating holes 34 and the long holes 35 are provided such that the expected conveying distances "Pe" obtained by subtracting the distance "a'" between the start trigger sensor 11 and the stop trigger sensor 12 from set lengths "Ls" for plural expected sheets Se become a substantially integer multiple of the perimeter of the driven roller 13.

With this structure, when the conveying distance "P" of the sheet S or the length "L" of the sheet S in the conveying direction is measured, the position of the stop trigger sensor 12 is manually adjusted using the sensor position adjusting unit 130 such that the expected conveying distance "Pe" obtained by subtracting the distance "a'" between the start trigger sensor 11 and the stop trigger sensor 12 from a set length "Ls" of a current expected sheet Se becomes a substantially integer multiple of the perimeter of the driven roller 13.

Thus, by providing the stop trigger sensor 12 or the start trigger sensor 11 movable with respect to the start trigger sensor 11 or the stop trigger sensor 12, respectively, the distance "a'" between the start trigger sensor 11 and the stop trigger sensor 12 can be variable. Therefore, the conveying distance "P" of various kinds of sheets can be accurately calculated.

Figure 12:
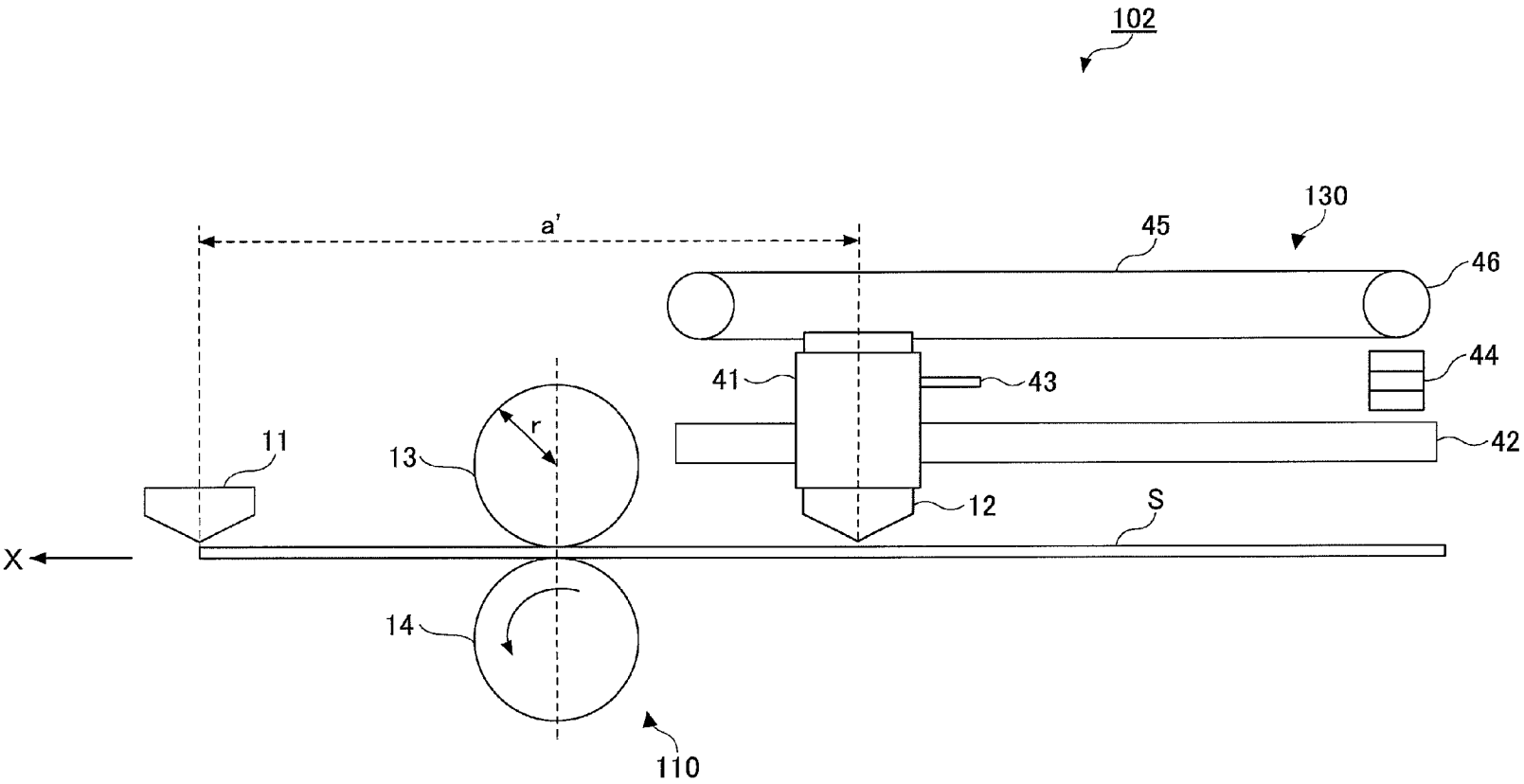
FIG. 12 is a schematic diagram showing an example of a sheet conveying apparatus of an embodiment.

FIG. 12 is a schematic diagram showing another example of the sheet conveying apparatus 102 of the embodiment.

In this example, the structure of the sensor position adjusting unit 130 is different from that shown in FIG. 11.

The sensor position adjusting unit 130 includes a carriage 41, a guide-rail 42, plural belt pulleys 46, an endless belt 45, a carriage position sensor 44 and a protruding portion for sensor 43.

The stop trigger sensor 12 is attached to the carriage 41. The carriage 41 is fixed to the endless belt 45 which is suspended around the plural belt pulleys 46. When the belt 45 is rotated in accordance with the rotations of the belt pulley 46, the carriage 41 is moved along the guide-rail 42 in the conveying direction of the sheet S.

The protruding portion for sensor 43 is attached to the carriage 41 to be positioned upstream of the carriage 41 in the conveying direction of the sheet S. The carriage position sensor 44 detects the position of the carriage 41 when the protruding portion for sensor 43 reaches the carriage position sensor 44. When the protruding portion for sensor 43 reaches the carriage position sensor 44 and is detected by the carriage position sensor 44, the movement of the carriage 41 is stopped and the position of the carriage 41 is controlled while having the stopped position as an initial position.

The position of the carriage 41 from the initial position can be accurately determined by driving and rotating the belt pulley 46 using a stepping motor or the like that controls a phase of the belt pulley 46, for example, so that the position of the stop trigger sensor 12 can be controlled.

Thus, by controlling the position of the stop trigger sensor 12 based on the set length "Ls" of the expected sheet Se such that the expected conveying distance "Pe" obtained by subtracting the distance "a'" between the start trigger sensor 11 and the stop trigger sensor 12 becomes a substantially integer multiple of the perimeter of the driven roller 13, the measurement error "C" in the measured conveying distance "P" caused by the eccentric amount of the driven roller 13 can be reduced to accurately measure the conveying distance "P" or the length of the sheet S "L" in the conveying distance.

Although the sensor position adjusting unit 130 is provided to adjust the position of the stop trigger sensor 12 in the conveying direction of the sheet S in this embodiment, alternatively, the sensor position adjusting unit 130 may be provided to adjust the position of the start trigger sensor 11. Further, the sensor position adjusting units 130 for both the start trigger sensor 11 and the stop trigger sensor 12 may be provided.

Fourth Embodiment

Figure 13:
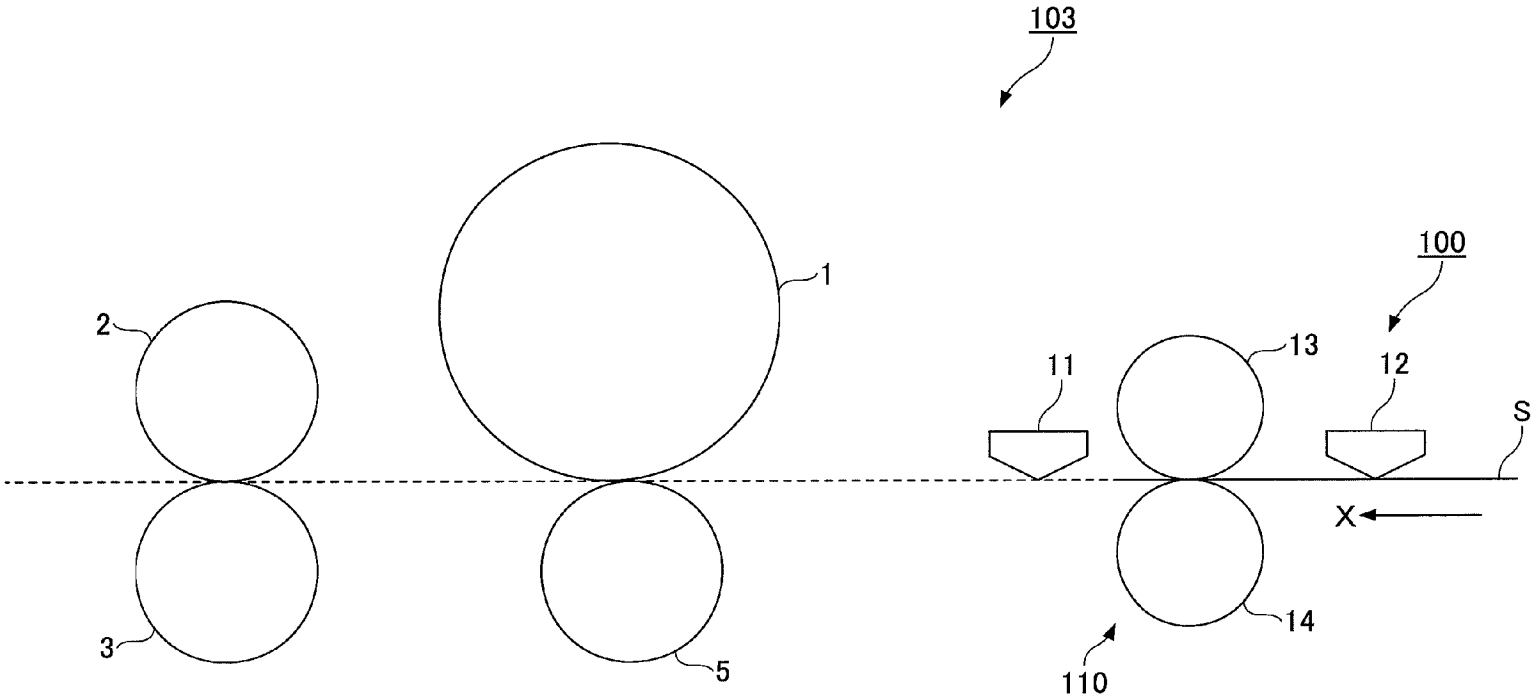
FIG. 13 is a schematic diagram showing an example of an image forming apparatus of an embodiment.
Figure 14:
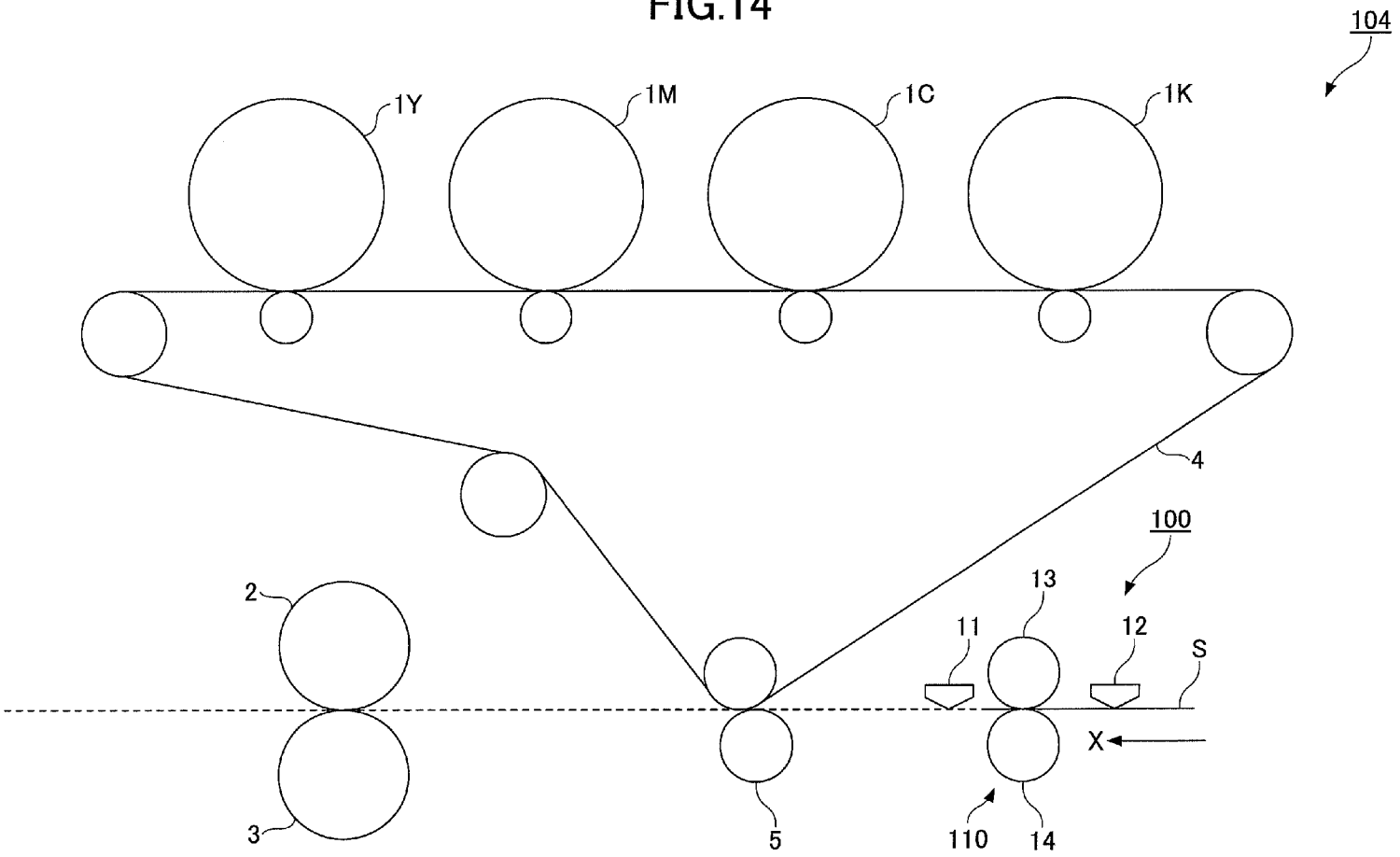
FIG. 14 is a schematic diagram showing an example of an image forming apparatus of an embodiment.

FIG. 13 and FIG. 14 are views schematically showing an example of an image forming apparatus including the sheet conveying apparatus 100. FIG. 13 shows an example of a monochrome image forming apparatus 103, and FIG. 14 shows an example of a tandem color image forming apparatus 104.

In the monochrome image forming apparatus 103 shown in FIG. 13, an image is printed on the conveyed sheet S as follows. First, a whole surface of a photoconductor drum 1 is charged while the photoconductor drum 1 is rotated. Then, an electrostatic latent image is formed on the surface of the photoconductor drum 1 by a light writing unit, not shown in the drawings. Then, the electrostatic latent image is developed to form a toner image by a developing unit, not shown in the drawings.

Subsequently, when the sheet S passes between the photoconductor drum 1 and a transfer unit 5, the toner image formed on the surface of the photoconductor drum 1 is transferred onto the sheet S. Thereafter, when the sheet S passes between a heat roller 2 and a pressure roller 3, the toner image is melted and fixed on the sheet S so that a printed image is formed on the sheet S.

In the tandem color image forming apparatus 104 shown in FIG. 14, an image is printed on the conveyed sheet S as follows. First, similar to the photoconductor drum 1 of the monochrome image forming apparatus 103, toner images formed on surfaces of photoconductor drums 1K, 1C, 1Y and 1M respectively provided for black (K), cyan (C), yellow (Y) and magenta (M) are primary transferred onto an intermediate transfer belt 4 in a superposed manner. Then, the superposed color toner image on the intermediate transfer belt 4 is secondary transferred onto the sheet S when the sheet S passes between the intermediate transfer belt 4 and the transfer unit 5.

The sheet S on which the color toner image is formed is further conveyed to pass between the heat roller 2 and the pressure roller 3 so that a printed image is formed on the sheet S.

For the image forming apparatuses 103 and 104 shown in FIG. 13 and FIG. 14, the sheet conveying apparatus 100 is placed right before (upstream of) the transfer unit 5 on the conveying path of the sheet S. Even for another image forming apparatus having a different structure, by placing the sheet conveying apparatus 100 right before (upstream of) a transfer unit, the conveying distance of the sheet S or the length of the sheet S in the conveying direction before transferring can be measured.

In the image forming apparatuses 103 and 104, first, the conveying distance of the sheet S is calculated by the sheet conveying apparatus 100. Then, a toner image is transferred on the sheet S by the transfer unit 5. Subsequently, when the sheet S is conveyed between the heat roller 2 and the pressure roller 3, a printed image is formed on one surface of the sheet S.

When printing images on both surfaces, the sheet S is reversed by a reverse mechanism, not shown in the drawings, and is conveyed again in a direction shown by an arrow X in FIG. 13 and FIG. 14. At this time, the sheet S is generally contracted by the heat so that the sheet S is conveyed under a condition that the size of the sheet S is changed. Then, the conveying distance is calculated by the sheet conveying apparatus 100 again, and a toner image is transferred and fixed on the back surface.

In this embodiment, the length of the toner image to be transferred on the back surface is corrected (image size correction is performed) based on the calculated relative ratio of the conveying distances before and after the heat fixing. Then, the corrected toner image is transferred on the back surface of the sheet S. Thus, the length of the images formed on the front surface and the back surface of the sheet S become the same to improve the registration in two-sided printing.

The contraction of the sheet S caused by the heat fixing recovers in accordance with time, thus, by measuring the conveying distance "P" right before the transfer unit 5, the length of the sheet S after the heat fixing can be accurately measured to improve the registration in two-sided printing.

By correcting the size of the image data or the timing of transferring the toner image on the sheet S based on the thus obtained conveying distance "P" of the sheet S or the length of the sheet S in the conveying direction, the registration error in two-sides printing caused by the expansion and contraction of the sheet S can be corrected to improve the registration in two-sided printing.

As described above, according to the sheet conveying apparatus 100, by setting the distance "a" between the start trigger sensor 11 and the stop trigger sensor 12 and the perimeter "2πr" of the driven roller 13 to satisfy the above equation (4) or (4'), the phases of the driven roller 13 at the start timing and the end timing are expected to become substantially the same within an allowable error range. Thus, the measurement error "C" caused by the eccentric amount of the driven roller 13 is reduced so that the conveying distance "P" or the length "L" of the sheet S in the conveying distance of the sheet S can be accurately measured.

According to the image forming apparatus 103 or 104 including the sheet conveying apparatus 100, as the conveying distance "P" or the length "L" of the sheet S can be accurately measured so that images can be printed on the sheet S with a higher registration in two-sided printing.

Figure 15:
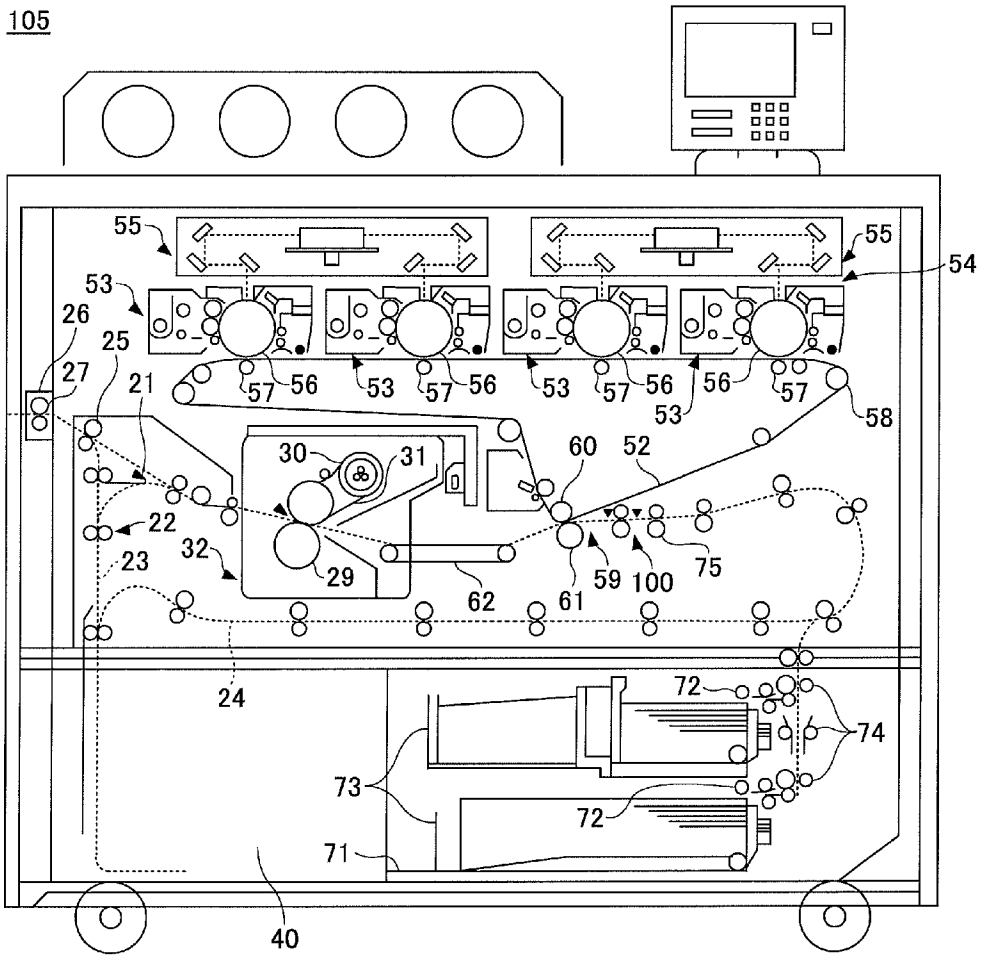
FIG. 15 is a schematic diagram showing an example of an image forming apparatus of an embodiment.

FIG. 15 is a view schematically showing an example of an image forming apparatus 105 including the sheet conveying apparatus 100.

The image forming apparatus 105 includes an intermediate transfer belt 52, a tandem image forming device 54, an exposure device 55, first transfer rollers 57, a second transfer device 59, the sheet conveying apparatus 100, a fixing device 32, a resist roller 75, a conveying belt 62, a feeding table 71, a de-curl unit 26 and a purge tray 40.

The intermediate transfer belt 52 is an endless belt and is provided at almost the center of the image forming apparatus 105. The intermediate transfer belt 52 is supported by plural support rollers 58 to be rotated in a clockwise direction in FIG. 15.

The tandem image forming device 54 includes plural image forming units 53 which are laterally aligned above the intermediate transfer belt 52 along the conveying direction of the transfer belt 52. The exposure device 55 is provided above the tandem image forming device 54.

Each of the image forming units 53 of the tandem image forming device 54 includes a photoconductor drum 56 as an image retaining member which retains a toner image of a respective color.

The first transfer rollers 57 are positioned to face the photoconductor drums 56 with the intermediate transfer belt 52 interposed therebetween at first transferring positions at which toner images are transferred to the intermediate transfer belt 52, respectively. The support rollers 58 function as drive rollers that rotate the intermediate transfer belt 52.

The second transfer device 59 is provided at an opposite side (downstream of the conveying direction of the intermediate transfer belt 52) of the tandem image forming device 54 while contacting the intermediate transfer belt 52. The second transfer device 59 includes a second transfer roller 61 and a second transfer opposing roller 60 which is facing the second transfer roller 61. The second transfer device 59 transfers a toner image formed on the intermediate transfer belt 52 onto the sheet S by pushing the second transfer roller 61 toward the second transfer opposing roller 60 while applying a transferring electric field. The second transfer device 59 varies the transferring current of the second transfer roller 61, which is a parameter for transferring, in accordance with the sheet S.

The sheet conveying apparatus 100 is provided upstream of the second transfer device 59 in the conveying direction of the sheet S. The fixing device 32 is provided downstream of the second transfer device 59 in the conveying direction of the sheet S. The fixing device 32 melts and fixes a toner image on the sheet S.

The sheet conveying apparatus 100 measures the conveying distance "P" of the sheet S or a length "L" of the sheet in the conveying direction of the sheet S before and after the sheet S passes the fixing device 32 in duplex printing. The image forming apparatus 105 corrects the size of the image to be formed on the back surface of the sheet S based on the ratio of expansion and contraction "R" which is calculated from the measured conveying distance "P" or the length "L" of the sheet S. Further, in this embodiment, the sheet conveying apparatus 100 is placed right before (upstream of) the second transfer device 59 and after (downstream of) the resist roller 75.

The fixing device 32 includes a pressure roller 29, a halogen lamp 30 as a heat source, and a fixing belt 31 which is an endless belt. The pressure roller 29 is pushed toward the fixing belt 31. The fixing device 32 changes a parameter for fixing such as temperatures of the fixing belt 31 and the pressure roller 29, a nip width between the fixing belt 31 and the pressure roller 29, and the speed of the pressure roller 29 in accordance with the sheet S. The sheet S on which the toner image is formed is conveyed to the fixing device 32 by the conveying belt 62.

When image data is sent to the image forming apparatus 105, and the image forming apparatus 105 receives a signal to start image formation, one of the support rollers 58 is rotated by a driving motor, not shown in the drawings, so that other support rollers 58 are also driven by the rotated support roller 58 to rotate and convey the intermediate transfer belt 52. At the same time, monochromatic images are formed on the respective photoconductor drums 56 of the image forming units 53. Then, the monochromatic images are transferred onto the intermediate transfer belt 52 by the first transfer rollers 57 while the intermediate transfer belt 52 is being conveyed so that a combined superposed color toner image is formed on the intermediate transfer belt 52.

One of feeding rollers 72 of the feeding table 71 is selected to be rotated so that a sheet S is sent from one of feeding cassettes 73 and is conveyed by conveying rollers 74 to the resist roller 75. Then, when the sheet S reaches the resist roller 75, there is a pause in the conveying of the sheet S. Then, the resist roller 75 is rotated at a timing of the combined color toner image on the intermediate transfer belt 52 so that the combined color toner image is transferred onto the sheet S at the second transfer device 59. The sheet S on which the combined color toner image is formed is further conveyed from the second transfer device 59 to the fixing device 32 where heat and pressure are applied to melt and fix the transferred combined color toner image on the sheet S.

Then, when forming images on both surfaces of the sheet S, the sheet S is conveyed on a sheet reversing path 23 and a two-way path 24 by a changeover claw 21 and a flip roller 22. Then, a combined color image toner is formed on the back surface of the sheet S by repeating the above described method.

When reversing and ejecting the sheet S, the sheet S is conveyed to the sheet reversing path 23 by the changeover claw 21, and then the sheet S is further conveyed to an ejecting roller 25 side by the flip roller 22 to reverse the front surface and the back surface of the sheet S.

When an image is formed only on one surface and reversing of the sheet S is not necessary, the sheet S is conveyed to the ejecting roller 25 by the changeover claw 21.

Subsequently, the ejecting roller 25 conveys the sheet S to the de-curl unit 26. The de-curl unit 26 includes a de-curl roller 27 and removes curling of the sheet S. The de-curl unit 26 changes the de-curl amount in accordance with the sheet S. The de-curl amount is adjusted by changing the pressure of the de-curl roller 27. Then, the sheet S is ejected from the de-curl roller 27. The purge tray 40 is provided below a sheet reversing unit such as the changeover claw 21, the flip roller 22 and the sheet reversing path 23.

(Correction of Image Size Based on Conveying Distance of the Sheet S)

The sheet conveying apparatus 100 measures the conveying distance "P" of the sheet S or the length "L" of the sheet S in the conveying direction of the sheet S by the above described method. Further, the sheet conveying apparatus 100 can measure the width of the sheet S in the direction (width direction) perpendicular to the conveying direction of the sheet S by contact image sensors (CISs), not shown in the drawings, positioned at edges of the sheet S, respectively.

After the conveying distance "P" of the sheet S or the sizes of the sheet S in the conveying direction and in the width direction are measured by the sheet conveying apparatus 100, the CISs or the like, a toner image is transferred onto the sheet S at the second transfer device 59. The sheet S on which the toner image is transferred is conveyed to the fixing device 32 where the toner image is fixed. There is a case where the sheet S is contracted by heat when passing through the fixing device 32.

Thereafter, the sheet S is reversed in the sheet reversing path 23 to be conveyed again to the sheet conveying apparatus 100. Then, the conveying distance "P" of the sheet S or the sizes of the sheet S in the conveying direction and in the width direction are measured again. Subsequently, a toner image is transferred and fixed on the back surface of the sheet S.

For a subsequent sheet S, the size or position of the toner image to be transferred on the back surface of the sheet S is corrected based on the ratio of expansion and contraction "R" of the measured sheet S. As a result, the size of the images to be formed on a front surface and a back surface of the sheet S are matched to improve the registration in two-sided printing.

The contraction of the sheet S after fixing recovers in accordance with time. Thus, by providing the sheet conveying apparatus 100 right before the second transfer device 59, the conveying distance "P" of the sheet S or the length "L" of the sheet S in the conveying direction is measured right before the toner image is transferred. With this structure, the ratio of expansion and contraction "R" can be accurately measured so that the registration in two-sided printing can be improved.

Correction of size of image based on the sheet size measured by the sheet conveying apparatus 100 is explained. As described above, in this embodiment, the sheet conveying apparatus 100 is provided right before the second transfer device 59; thus, the correction of the exposing data size or exposing timing based on the measured sheet size is not reflected on the sheet S for which the sheet size is measured, but reflected on a subsequent sheet S.

The exposure device 55 includes a data buffer unit that buffers input image data, an image data generating unit that generates image data for forming an image, an image size correction unit that corrects the size of the image data in the conveying direction of the sheet S based on the sheet size, a clock generating unit that generates a writing clock, and a light emitting device that forms an image by emitting a light on the photoconductor drum 56.

The data buffer unit is composed of a memory or the like. The data buffer unit stores the input image data sent from a host apparatus such as a controller or the like, not shown in the drawings, at a transferring clock.

The image data generating unit generates the image data based on the writing clock sent from the clock generating unit and size correction data sent from the image size correction unit. Then, the light emitting device is controlled to be ON/OFF by drive data output from the image data generating unit while having a length corresponding to one cycle of a writing clock as one pixel.

The image size correction unit generates the size correction data based on the sheet size measured by the sheet conveying apparatus 100.

The clock generating unit is operated at high frequency which is a few times of the writing clock in order to change clock period, and performs an image correction with such as a known technique called pulse width modulation. The clock generating unit generates the writing clock at a frequency basically corresponding to the speed of the image forming apparatus 103.

The light emitting device is composed of one or a combination of a diode laser, a diode laser array, a vertical cavity surface emitting laser and the like. The light emitting device irradiates light on the photoconductor drum 56 in accordance with the drive data to form the electrostatic latent image on the photoconductor drum 56.

A pre-fixed image, which is a toner image, formed on the sheet S is fixed on the sheet S at the fixing device 32 by being heated and pressed. The sheet S may be deformed by the heat or the pressure so that the length of the sheet S in the conveying direction of the sheet S may be changed by expansion and contraction. As a result, there may be caused a difference in position between an image forming region on the back surface and that of the front surface of the sheet S to have influence on quality of output images, and registration in two-sided printing (as the image on the front surface is deformed so as to be shifted from the image on the back surface). The fixing device 32 may separately perform heating and pressing, or may be a flash fixing type.

Thus, according to the image forming apparatus 105, size of image and the image forming region are changed in accordance with the measured sheet size to compensate for the deformation of the sheet S caused by the fixing device 32. With this structure, even when the sheet S is deformed, registration in two-sided printing of the sheet S can be improved.

The sheet size, including the deformation of the sheet S, is obtained from the sheet conveying apparatus 100. Further, the image forming apparatus 105 can perform only expanding, only reducing, or a combination of expanding and reducing based on the deformation of the sheet S.

In duplex printing, the sheet S is deformed when fixing the toner image formed on a front surface of the sheet S while the sheet S is conveyed with a first end of the sheet S in front. Thereafter, the sheet S is reversed in the sheet reversing path 23 of the image forming apparatus 105. Then, the sheet S is conveyed with a second end, opposite end of the first end, of the sheet S in front to be inserted into the fixing device 32. At this time, if the image forming region is not corrected, a back end of an image formed on the back surface of the sheet S is shifted from a back end of an image formed on the front surface of the sheet S to reduce registration in two-sided printing.

However, according to the image forming apparatus 105, as the size of image and the image forming region are corrected when forming an image on the back surface of the sheet S, the registration in two-sided printing of the sheet S can be improved.

(Peripheral Speeds of Rollers of the Second Transfer Apparatus and the Sheet Conveying Apparatus)

The relationship of the peripheral speeds of the second transfer opposing roller 60 and the second transfer roller 61 of the second transfer device 59, and the driven roller 13 and the drive roller 14 of the sheet conveying apparatus 100 is explained.

The sheet conveying apparatus 100 includes the driven roller 13, the drive roller 14, a motor (an example of the driving unit 20) and a one-way clutch (an example of the driving force transmitting unit 22) provided between the drive roller 14 and the motor.

As described above, the drive roller 14 is rotated by the driving force by the motor via the driving force transmitting unit. The driven roller 13 is rotated in accordance with the rotation of the drive roller 14 with the sheet S interposed between the drive roller 14 and the driven roller 13.

The one-way clutch provided between the drive roller 14 and the motor transmits the driving force to the drive roller 14 in a conveying direction in which the drive roller 14 conveys the sheet S, and stops transmitting the driving force to the drive roller 14 in a direction which is opposite to the conveying direction by slipping.

The sheet conveying apparatus 100 receives the sheet S from the resist roller 75, and conveys the sheet S at a predetermined speed such that a front end of the sheet S is inserted into the second transfer device 59 at a predetermined timing. The speed of conveying the sheet S by the sheet conveying apparatus 100 is controlled by the speed of the drive roller 14.

The second transfer device 59 receives the sheet S from the sheet conveying apparatus 100 and further conveys the sheet S. The second transfer device 59 transfers the toner image onto a surface of the sheet S.

The second transfer device 59 includes the intermediate transfer belt 52, the second transfer roller 61, a motor that independently drives the intermediate transfer belt 52 and the second transfer roller 61 and a torque limiter provided between the second transfer roller 61 and the motor.

The torque limiter provided between the second transfer roller 61 and the motor transmits the driving force of the motor to the second transfer roller 61 within a range of a limited load torque and stops transmitting the driving force from the motor to the second transfer roller 61 when the load torque exceeds a predetermined value by slipping.

The sheet conveying apparatus 100 may include a contact control mechanism that is configured to control the driven roller 13 or the drive roller 14 so that the driven roller 13 and the drive roller 14 are apart from each other when the sheet S is not being conveyed and the driven roller 13 and the drive roller 14 are in contact with each other when the sheet S is being conveyed. Further, the second transfer device 59 may also include a contact control mechanism that is configured to control the second transfer roller 61 or the second transfer opposing roller 60 so that the second transfer roller 61 and the second transfer opposing roller 60 are apart from each other when the sheet S is not being conveyed and the second transfer roller 61 and the second transfer opposing roller 60 are in contact with each other when the sheet S is being conveyed.

The sheet conveying apparatus 100 is configured to output a driving force of the motor connected to and driving the drive roller 14 at a peripheral (linear) speed "Va". When the sheet S is conveyed only by the sheet conveying apparatus 100, the one-way clutch transmits the driving force of the motor to the drive roller 14. At this time, as the drive roller 14 is being rotated at the peripheral speed "Va", the sheet S is also conveyed at the speed "Va".

In the second transfer device 59, the intermediate transfer belt 52 is rotated at a peripheral (linear) speed "Vb" (Vb>=Va), and the motor connected to the second transfer roller 61 outputs a driving force that causes the second transfer roller 61 to be rotated at a peripheral (linear) speed "Vc" (Vc>=Vb).

Here, slip torque "Ts" of the torque limiter provided between the second transfer roller 61 and the motor is set between load torque "To" when the intermediate transfer belt 52 and the second transfer roller 61 are apart from each other, and load torque "Tc" when the intermediate transfer belt 52 and the second transfer roller 61 are in contact with each other (To<Ts<Tc).

Thus, when the second transfer roller 61 is apart from the intermediate transfer belt 52, the load torque "To" of the torque limiter is less than the slip torque "Ts". Therefore, the torque limiter transmits driving force of the motor to the second transfer roller 61 so that the second transfer roller 61 is rotated at the peripheral speed "Vc". When the second transfer roller 61 is in contact with the intermediate transfer belt 52, the load torque "Tc" of the torque limiter exceeds the slip torque "Ts". Thus, the torque limiter stops transmitting the driving force from the motor to the second transfer roller 61 so that the second transfer roller 61 is rotated in accordance with the intermediate transfer belt 52 at the peripheral speed "Vb".

Under this situation, when the sheet S is conveyed by both the sheet conveying apparatus 100 and the second transfer device 59, the sheet S is conveyed at the peripheral speed "Vb" of the intermediate transfer belt 52, where the one-way clutch of the sheet conveying apparatus 100 slips to stop transmitting the driving force from the motor to the drive roller 14. Thus, at this time, the drive roller 14 is rotated in accordance with the sheet S, which is conveyed at the linear speed "Vb" with the driven roller 13.

With this structure, when the sheet S is passed from the sheet conveying apparatus 100 to the second transfer device 59 and the toner image is being transferred onto the sheet S, the sheet S is conveyed at a constant linear speed "Vb", which is the peripheral speed "Vb" of the intermediate transfer belt 52. By maintaining the sheet conveying speed while the toner image is being transferred, an abnormal image with such as banding or the like can be prevented from being generated, and the image forming apparatus 105 can form uniform images.

The peripheral speed "Va" of drive roller 14, the peripheral speed "Vb" of the intermediate transfer belt 52 and the peripheral speed "Vc" of the second transfer roller 61 may be defined as the following equation (5). In this case, the above merit can be obtained.

$$Va=<Vb=<Vc \tag{5}$$

However, if the difference between the peripheral speed "Va" and the peripheral speed "Vb" or between the peripheral speed "Vb" and the peripheral speed "Vc" is large, a slipping amount of the one-way clutch or the torque limiter when conveying the sheet S becomes large and the service lifetime of the one-way clutch or the torque limiter is lowered by heat, abrasion or the like. Thus, the difference between these peripheral speeds may be preferably set smaller and may be set equal to each other. However, if the peripheral speeds of the drive roller 14, the intermediate transfer belt 52 and the second transfer roller 61 change due to environmental variation such as temperature and relative humidity or the like and become not to meet the equation (5), the conveying speed of the sheet S is varied when transferring the toner image onto the sheet S to cause size change of the toner image formed on the sheet S. Thus, predetermined margins may be provided between the peripheral speed "Va" and the peripheral speed "Vb", and between the peripheral speed "Vb" and the peripheral speed "Vc".

The peripheral speeds "Va", "Vb" and "Vc" may be defined by the following equations (6) and (7).

$$0.90Vb=<Va=<0.99Vb \quad (6)$$

$$1.001Vb=<Vc=<1.05Vb \quad (7)$$

Further, preferably, the peripheral speeds "Va", "Vb" and "Vc" may be defined by the following equations (8) and (9) in order to maintain the service lifetime of the one-way clutch or the torque limiter, and obtain the above described merit considering the environmental variation or the like.

$$0.95Vb=<Va=<0.99Vb \quad (8)$$

$$1.001Vb=<Vc=<1.02Vb \quad (9)$$

With the above structure, the sheet conveying speed of the sheet S when transferring the toner image can be maintained at a constant value so that an abnormal image with such as banding or the like can be prevented from being generated, and the image forming apparatus 105 can form uniform images on the sheet S.

Further, for an image forming apparatus in which a toner image is directly transferred from the photoconductor drum to the sheet S, the sheet conveying speed may be maintained at a constant value when transferring the toner image by a similar method as described above. In this case, the intermediate transfer belt 52 may correspond to the photoconductor drum, and the second transfer roller 61 may correspond to a transfer roller that transfers an image from the photoconductor drum to the sheet S.

Further, instead of the one-way clutch provided between the drive roller 14 and the motor of the sheet conveying apparatus 100, a torque limiter may be provided by which slip torque is set so that the drive roller 14 is rotated in accordance with the sheet S for both the sheet conveying apparatus 100 and the intermediate transfer belt 52 when the sheet S is being conveyed.

The image forming apparatus 103, 104 or 105 may include the sheet conveying apparatus 101 or 102 instead of the sheet conveying apparatus 100. In such a case, the same merit can be obtained.

Further, after a predetermined period after the sheet S is inserted between the driven roller 13 and the drive roller 14, velocity turbulences of the driven roller 13 and the drive roller 14 are caused at the resonance frequencies of the driven roller 13 and the drive roller 14. This causes a measurement error. Thus, it is necessary to set the distance "A" between the start trigger sensor 11 and the driven roller 13 (and the drive roller 14) to be larger than the distance necessary for the velocity turbulence of the driven roller 13 to dissipate.

The individual constituents of the pulse measuring unit 116 and the conveying distance calculation unit 117 of the sheet conveying apparatus 100 may be embodied by arbitrary combinations of hardware and software, typified by a CPU of an arbitrary computer, memory, a program loaded in the memory so as to embody the constituents illustrated in the drawings, storage units for storing the program such as a hard disk, and an interface for network connection. It may be understood by those skilled in the art that methods and devices for the embodiment allow various modifications.

According to the embodiment, a sheet conveying apparatus which is capable of reducing the measurement error "C" in the sheet conveying distance "P" caused by the eccentric amount of the drive roller or the driven roller as the phases of the drive roller or the driven roller at the start timing and the end timing are expected to become substantially the same within an allowable error range. Further, according to the embodiment, a sheet conveying apparatus is capable of improving the registration in two-sided printing by accurately obtaining the conveying distance "P".

Further, in the above embodiments, in order to reduce influence of velocity turbulence of a conveying unit other than that of the sheet conveying apparatus 100 while the conveying amount of the sheet S is being measured, the sheet S may be conveyed only by the sheet conveying unit 110 when the conveying amount of the sheet S is being measured.

Although a preferred embodiment of the sheet conveying apparatus and the image forming apparatus has been specifically illustrated and described, it is to be understood that minor modifications may be made therein without departing from the sprit and scope of the invention as defined by the claims.

The present invention is not limited to the specifically disclosed embodiments, and variations and modifications may be made without departing from the scope of the present invention.

What is claimed is:

1. A sheet conveying apparatus comprising:

a first roller and a second roller that convey a sheet along a conveying path of the sheet so that the sheet is inserted between the first roller and the second roller;

an upstream detection unit that detects the sheet upstream of the first roller and the second roller on the conveying path;

a downstream detection unit that detects the sheet downstream of the first roller and the second roller on the conveying path, the downstream detection unit being positioned apart from the second roller for a distance longer than the distance necessary for a velocity turbulence of the second roller that is generated when the sheet is inserted between the first roller and the second roller to dissipate;

a conveying amount measuring unit that measures a conveying amount of the sheet conveyed by the first roller or the second roller; and a conveying distance calculation unit that calculates a conveying distance of the sheet conveyed by the first roller and the second roller based on detected results by the upstream detection unit and the downstream detection unit and a measured result by the conveying amount measuring unit, wherein a conveying distance of the sheet conveyed by the first roller and the second roller within a period between when the sheet is detected by the downstream detection unit and when the sheet is detected by the upstream detection unit is substantially an integer multiple of perimeter of the first roller.

2. The sheet conveying apparatus according to claim 1, further comprising:

a plurality of at least either of the downstream detection units and the upstream detection units provided at different positions in a conveying direction of the sheet.

3. An image forming apparatus comprising:

the sheet conveying apparatus according to claim 1; and a transfer unit that transfers a toner image onto the sheet.

4. A sheet conveying apparatus comprising:

a first convey unit that includes a first roller, a first drive unit that outputs a driving force to rotate the first roller at a first peripheral speed Va, an one-way clutch that transmits the driving force output by the first drive unit to the first roller only in a direction that the first roller is rotated to convey a sheet in a conveying direction of the sheet, and a second roller that is driven to rotate in accordance with the rotation of the first roller and convey the sheet with the first roller so that the sheet is inserted between the first roller and the second roller; and a second convey unit that receives the sheet from the first convey unit and includes, a third roller that is rotated at a second peripheral speed Vb that is faster than or equal to the first peripheral speed Va, a fourth roller that conveys the sheet along a conveying path of the sheet with the third roller, a second drive unit that outputs a driving force to rotate the fourth roller at a third peripheral speed Vc that is faster than or equal to the second peripheral speed Vb, a torque limiter that is provided between the second drive unit and the fourth roller, whose slip torque is set to be less than load torque generated when the third roller and the fourth roller are in contact with each other and stops transmitting the driving force from the second drive unit to the fourth roller when the third roller and the fourth roller are in contact with each other;

an upstream detection unit that detects the sheet upstream of the first roller and the second roller on the conveying path;

a downstream detection unit that detects the sheet downstream of the first roller and the second roller on the conveying path;

a conveying amount measuring unit that measures a conveying amount of the sheet conveyed by the first roller or the second roller; and a conveying distance calculation unit that calculates a conveying distance of the sheet conveyed by the first roller and the second roller based on detected results by the upstream detection unit and the downstream detection unit and a measured result by the conveying amount measuring unit, wherein a conveying distance of the sheet conveyed by the first roller and the second roller within a period between when the sheet is detected by the downstream detection unit and when the sheet is detected by the upstream detection unit is substantially an integer multiple of perimeter of the first roller.

5. An image forming apparatus comprising:

the sheet conveying apparatus according to claim 4; and a transfer unit that transfers a toner image onto the sheet.

6. A sheet conveying apparatus comprising:

a driver roller and a driven roller that convey a sheet along a conveying path of the sheet so that the sheet is inserted between the driver roller and the driven roller;

an upstream detection unit that detects the sheet upstream of the driver roller and the driven roller on the conveying path;

a downstream detection unit that detects the sheet downstream of the driver roller and the driven roller on the conveying path, the downstream detection unit being positioned apart from the driven roller for a distance longer than the distance necessary for a velocity turbulence of the driven roller that is generated when the sheet is inserted between the drive roller and the driven roller to dissipate; and a conveying amount measuring unit that measures a conveying amount of the sheet by counting a pulse signal of a rotary encoder provided at a rotation axle of the driver roller or the driven roller, wherein a conveying distance of the sheet conveyed by the drive roller and the driven roller within a period between when the sheet is detected by the downstream detection unit and when the sheet is detected by the upstream detection unit is substantially an integer multiple of perimeter of the drive roller or the driven roller.

7. The sheet conveying apparatus according to claim 6, further comprising:

a conveying distance calculation unit that calculates a conveying distance of the sheet conveyed based on a detected result by the upstream detection unit and the downstream detection unit and a measured result by the conveying amount measuring unit.

8. The sheet conveying apparatus according to claim 6, wherein the distance between the downstream detection unit and the upstream detection unit is determined to be within a predetermined range based on a range of an allowable measurement error of the conveying amount measuring unit.

* * * * *